US010019866B2

(12) United States Patent
Vermaak et al.

(10) Patent No.: US 10,019,866 B2
(45) Date of Patent: Jul. 10, 2018

(54) GAMING MACHINE WITH WILD MULTIPLIER FEATURE

(71) Applicant: Pridefield Limited, Douglas (IM)

(72) Inventors: Richard Vermaak, Durban (ZA); Jonathan Bruce Wortmann, Cowies Hill (ZA)

(73) Assignee: Pridefield Limited, Douglas (IM)

( * ) Notice: Subject to any disclaimer, the term of this patent is extended or adjusted under 35 U.S.C. 154(b) by 641 days.

(21) Appl. No.: 14/585,351

(22) Filed: Dec. 30, 2014

(65) Prior Publication Data

US 2015/0199867 A1 Jul. 16, 2015

(30) Foreign Application Priority Data

Jan. 13, 2014 (GB) ..... 1400515.1

(51) Int. Cl.
*G07F 17/32* (2006.01)
*G07F 17/34* (2006.01)

(52) U.S. Cl.
CPC ..... *G07F 17/3213* (2013.01); *G07F 17/326* (2013.01); *G07F 17/34* (2013.01)

(58) Field of Classification Search
USPC ..... 463/20
See application file for complete search history.

(56) References Cited

U.S. PATENT DOCUMENTS 7,758,414 B1 7/2010 Marks et al.
9,728,034 B2 * 8/2017 Vancura ..... G07F 17/326
2004/0048650 A1 3/2004 Mierau et al.
2005/0054436 A1 3/2005 Frizzel et al.
2005/0075163 A1 4/2005 Cuddy et al.
2006/0189377 A1 8/2006 Gomez et al.
2008/0108411 A1 5/2008 Jensen et al.
2010/0016061 A1 1/2010 Gomez et al.
2010/0190542 A1 7/2010 Hayato
(Continued)

OTHER PUBLICATIONS

Wikipedia, User Datagram Protocol, downloaded from the World Wide Web at http://en.wikipedia.org/wiki/User_Datagram_Protocol on Dec. 31, 2013, 4 pages.
(Continued)

*Primary Examiner* — Pierre E Elisca
(74) *Attorney, Agent, or Firm* — McDonnell Boehnen Hulbert & Berghoff LLP

(57) ABSTRACT

Machines and methods are described for displaying a predetermined symbol and a set of symbols selected from a global symbol set. A first symbol position can be randomly selected for displaying the predetermined symbol, which can include a multiplier meter to display a multiplier value randomly selectable from multiple multiplier values. A second symbol position can be randomly selected for displaying the predetermined symbol after moving along a path from the first symbol position. The predetermined symbol can be displayed as part of a predetermined number of outcome events earned upon determination that a trigger event occurred. A server machine can select symbol positions, multiplier values and symbol sets and provide data indicating the symbol positions, multiplier values and symbol sets to a client machine. The client machine can include a display to display the symbol sets, and multiplier values within a predetermined symbol.

20 Claims, 17 Drawing Sheets

(56) References Cited

U.S. PATENT DOCUMENTS

| | | | | |
|---|---|---|---|---|
| 2013/0023325 | A1 | 1/2013 | Saunders et al. | |
| 2014/0094248 | A1 * | 4/2014 | Vancura | G07F 17/326 463/20 |

OTHER PUBLICATIONS

European Patent Office, Munich, Germany; Extended European Search Report regarding Application No. 15275006.3-1995 on EPO Form 1507N, dated May 27, 2015, 6 pages.

* cited by examiner

GAMING MACHINE WITH WILD MULTIPLIER FEATURE

PRIORITY

This application claims priority under 35 U.S.C. § 119 to United Kingdom Patent Application No. 1400515.1 filed Jan. 13, 2014. United Kingdom Patent Application No. 1400515.1 is hereby incorporated by reference in its entirety.

TECHNICAL FIELD

This disclosure relates to gaming machines for playing games such as wager games.

BACKGROUND

Wager games come in a variety of forms, including for example a mechanical slot machine. A mechanical slot machine may include one or more reels, each of which includes multiple symbols distributed around the circumference of the reel. When a player places a wager (e.g., by placing a coin in the machine), the player is allowed to spin the reels. Each reel then comes to rest, typically with either one of the symbols, or a space in between symbols, in alignment with a pay line. A predefined winning symbol or a predefined combination of winning symbols that are aligned with the pay line can result in the player winning the game and receiving a payout. In one example, the machine may include three reels, and the pay line may be a horizontal line disposed across a centre of each of the three reels.

In another example of a wager game, a mechanical slot machine may present symbols in a matrix arrangement, with each symbol changing during a spin of the game. For example, the machine may have five columns and three rows of symbols, for a total of fifteen symbols. Such machines often have multiple pay lines, each being defined by a collection of positions within the matrix. For example, the machine may have three pay lines, each corresponding to one row of the matrix.

While slot machines were traditionally mechanical, modern slot machines often take the form of a video gaming machine (e.g., a dedicated gaming machine located in a casino) that includes a graphical user interface (GUI), and that may emulate a mechanical slot machine. With a video gaming machine, the GUI may include a display that displays an image of one or more reels or a matrix as described above, together with animation effects to simulate a spin of the one or more reels, or a spin of the columns or rows of the matrix. A computer software program, which may reside in the video gaming machine, may randomly select one or more symbols in response to a spin, and may display the selected one or more symbols on the display.

A modern slot machine may also be played over a computer-network, such as by a player using a client machine that is connected to a server machine over the computer-network. In this instance, the server machine may perform the spins of the game and may send the resulting symbols to the client machine for display.

The popularity of video slot games has increased due to the incorporation of a "wild" symbol into such video slot games. A wild symbol, which is usually the highest-ranking symbol of the game, offers line payouts just like any other symbol and, additionally substitutes for any other symbol in the game, thereby assisting in making winning results and providing a player with entertainment and additional opportunities to win games.

SUMMARY

Viewed from one aspect, the disclosure provides a machine comprising: a display configured to display symbols in a wager outcome event; a processor; and a non-transitory computer-readable medium storing program instructions, that when executed by the processor, cause a set of functions to be performed, the set of functions comprising: displaying, by the display, a predetermined symbol resting at a first symbol position within a symbol-display-portion of the display; determining, by the processor, a first symbol set to display within the symbol-display-portion of the display for a first outcome event; determining, by the processor, a second symbol position within the symbol-display-portion of the display for the first outcome event; and displaying, simultaneously by the display within the symbol-display-portion for the first outcome event, the first symbol set, and the predetermined symbol resting at the second symbol position.

The machine may further be configured for receiving a play request via a user interface. In this instance, the machine may determine the first symbol set or the second symbol position in response to receiving the play request.

In some embodiments, the trigger event comprises a randomly occurring event. For instance, the trigger event may include the machine selecting a particular trigger symbol, such as in connection with a previous outcome event, such as a play of a game.

The machine may be in the form of a stand-alone gaming machine which incorporates a data processing module (e.g., a logic module) and a display. Alternatively, the machine may comprise a server machine, and a client machine that incorporates a data processing module and a display, the server machine and the client machine being remote from each other.

Viewed from a second aspect, the disclosure provides a method comprising: displaying, by a display of a machine, a predetermined symbol resting at a first symbol position within a symbol-display-portion of the display; determining, by a processor of the machine, a first symbol set to display within the symbol-display-portion of the display for a first outcome event; determining, by the processor, a second symbol position within the symbol-display-portion of the display for the first outcome event; and displaying, simultaneously by the display within the symbol-display-portion for the first outcome event, the first symbol set, and the predetermined symbol resting at the second symbol position.

Viewed from a third aspect, the disclosure provides a server machine comprising: a processor, a communication interface, and a non-transitory computer-readable medium storing software instructions, that when executed by the processor, perform a set functions, wherein the set of functions comprise: sending, by the communication interface to a client machine over a computer-network, data indicating a predetermined symbol to be displayed resting at a first symbol position within a symbol-display-portion of a client device display; determining, by the processor, a first symbol set to display within the symbol-display-portion of the display for a first outcome event; determining, by the processor, a second symbol position within the symbol-display-portion of the client device display for the first outcome event; and sending, by the communication interface to the client machine over the computer-network, data indicating the first symbol set and the second symbol position so that the client device display can display simultaneously within the symbol-display-portion for the first outcome event, the first symbol set, and the predetermined symbol resting at the second symbol position.

Viewed from a fourth aspect, the disclosure provides a client machine comprising: a processor, a display, a communication interface, and a non-transitory computer-readable medium storing software instructions, that when executed by the processor, perform a set functions, wherein the set of functions comprise: displaying, by the display, a predetermined symbol resting at a first symbol position within a symbol-display-portion of the display; receiving, by the communication interface, a first symbol set to display within the symbol-display-portion of the display for a first outcome event; receiving, by the communication interface, data indicating a second symbol position within the symbol-display-portion of the display for the first outcome event; and displaying, simultaneously by the display within the symbol-display-portion for the first outcome event, the first symbol set, and the predetermined symbol resting at the second symbol position. The communication interface can receive the first symbol set and the data indicating the second symbol position from a server machine.

The features listed above as being features of embodiments of the first aspect of the disclosure, are equally applicable to embodiments of the second, third, fourth and fifth embodiments of the disclosure.

In embodiments of the disclosure in which a computer software product is used, the product may be non-transitory and store instructions on physical media such as a DVD, or a solid state drive, or a hard drive. Alternatively, the product may be transitory and in the form of instructions provided over a connection such as a network connection which is linked to a network such as the Internet.

DESCRIPTION OF THE FIGURES

Some embodiments of the disclosure will now be described by way of example and with reference to the accompanying drawings.

DETAILED DESCRIPTION

I. Introduction

This description describes several example embodiments including, but not limited to, example embodiments pertaining to performing aspects of an outcome event using a machine. Performing the outcome event can include playing a game. The machine can display a variety of symbols during performance of an outcome event. A displayed symbol can be a predetermined symbol that moves between two different symbol positions within a symbol-display-portion of a display during an outcome event. The predetermined symbol can include a multiplier meter that displays a randomly determined multiplier value. The multiplier value can be used to determine a payout amount for an outcome event in which a wager is won.

Throughout this description, the articles "a" or "an" are used to introduce elements of the example embodiments. Any reference to "a" or "an" refers to "at least one," and any reference to "the" refers to "the at least one," unless otherwise specified, or unless the context clearly dictates otherwise. The intent of using the conjunction "or" within a described list of at least two terms is to indicate any of the listed terms or any combination of the listed terms. The use of ordinal numbers such as "first," "second," "third" and so on is to distinguish respective elements rather than to denote a particular order of those elements.

For purpose of this description, the terms "multiple" and "a plurality of" refer to "two or more" or "more than one."

Disclosed herein are machines and methods for carrying out aspects of outcome events that include displaying symbols, such as games, in particular, wager games. In one aspect, the machines and methods provide a feature that may enhance traditional wager games (e.g., slot machines or other reel-type games) by providing a player with additional opportunities to win the game, thereby increasing the player's interest, anticipation, and excitement in connection with the game. This may in turn benefit a casino or another entity that provides a game with this feature. Indeed, wager games are typically configured to have odds that favor the casino (sometimes referred to as the "house"). Accordingly, based on the law of averages, casinos often maximize their profits simply by getting more players to play more games. Due to the provided feature, players may be drawn in (e.g., from competing casinos that lack games with such a feature) and they may play the game often. The feature can include new data communications between a server machine and a client machine within a server-client based configuration.

II. Example Architecture

Figure 1:
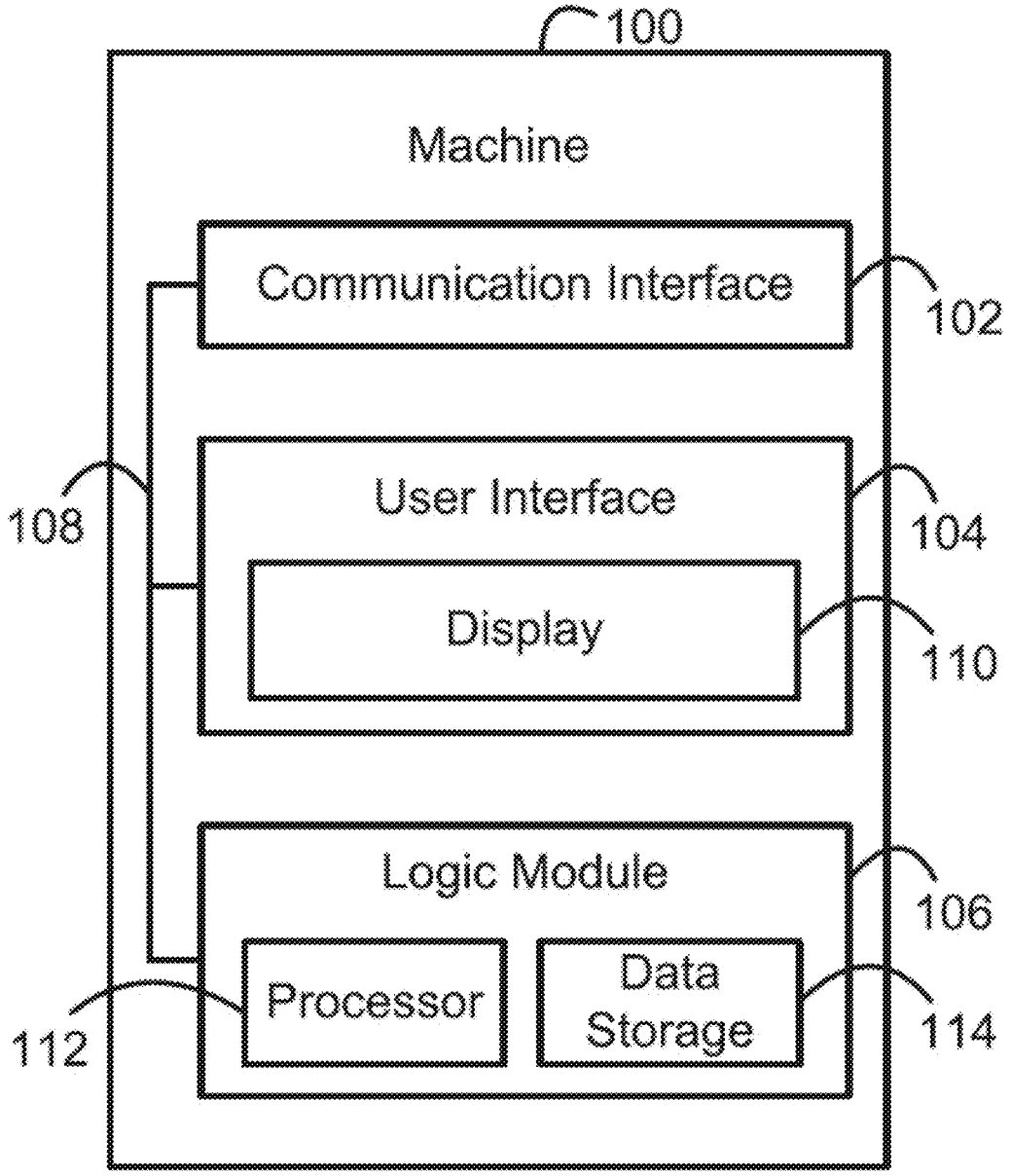
FIG. 1 is a simplified block diagram of an embodiment of a machine in accordance with the disclosure.

FIG. 1 shows a simplified block diagram of an example machine 100 arranged to implement functions in accordance with example methods described herein. Machine 100 may take any of a variety of forms, including for example a dedicated gaming machine, a personal computer, a personal digital assistant, a mobile phone, a tablet device, or some other computing device.

Machine 100 may include a communication interface 102, a user interface 104, and a logic module 106, all of which may be coupled together by a system bus, network, or other connection mechanism 108. The communication interface 102 may include a wired or wireless network communication interface. For purposes of this description any data described as being sent or transmitted by machine 100 can be data sent by communication interface 102 over a communication network. Also, for purposes of this description any data described as being received by machine 100 can be data sent to communication interface 102 over a communication network.

The user interface 104 may facilitate interaction with a user (e.g., a player of a game) if applicable. As such, the user interface 104 may take the form of a GUI and may include output components such as a speaker and a display 110, and input components such as a keypad or a touch-sensitive screen. As described in greater detail below, display 110 may be configured to display, among other things, a symbol set in a game or a portion thereof.

The logic module 106 can take the form of a processor 112 and a data storage 114. The processor 112 can include a general-purpose processor (e.g., a microprocessor) or a special-purpose processor (e.g., a digital signal processor or an application specific integrated circuit) and may be integrated in whole or in part with the communication interface 102 or the user interface 104. Any processor discussed in this description or shown in the drawings can be referred to as a computer-readable processor. Any data storage discussed in this description or shown in the drawings can be referred to as computer-readable data storage.

Data storage 114 may include volatile or non-volatile storage components and may be integrated in whole or in part with processor 112. Data storage 114 may take the form of a non-transitory computer-readable medium and may include software program instructions, that when executed by processor 112, cause machine 100 to perform one or more of the functions described herein. Any software program instructions discussed in this description or shown in the drawings can be referred to as computer-readable program instructions, or more simply, program instructions.

Data storage 114 may also include operating system software on which machine 100 may operate. For example, machine 100 may operate on a Windows™-based operating system (e.g., Windows XP or Windows 7) provided by the Microsoft™ Corporation of Redmond, Wash.

Figure 2:
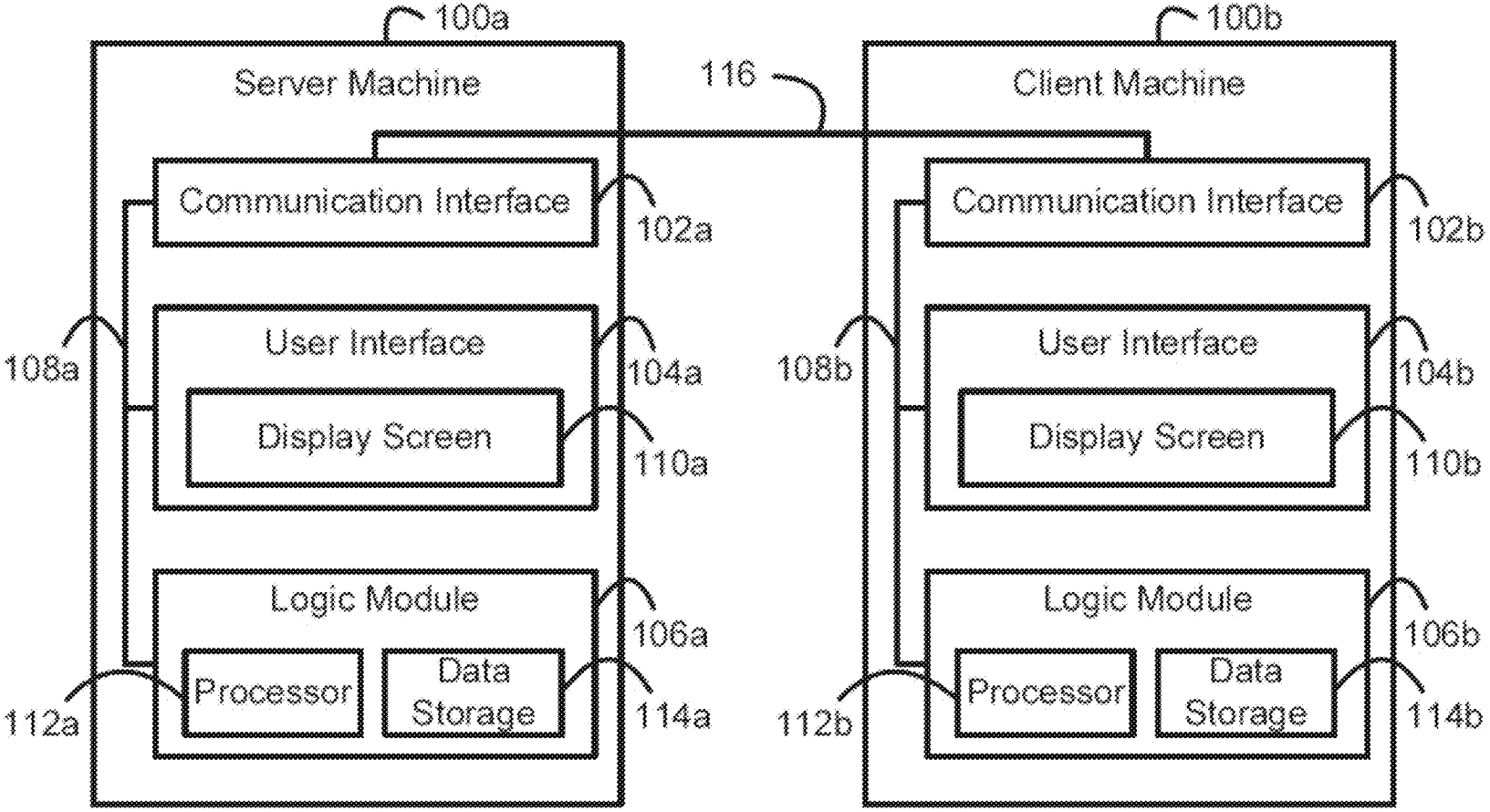
FIG. 2 is a simplified block diagram of an example server machine connected to an example client machine over a computer-network, in an embodiment of the disclosure.

FIG. 2 is a simplified block diagram of an example server machine 100*a* connected to an example client machine (sometimes referred to as a workstation) 100*b* over a computer-network 116. A configuration of elements including server machine 100*a* and client machine 100*b* can be referred to as a server-client based configuration.

The components of the server machine 100*a* and the client machine 100*b* are shown with corresponding "a" and "b" reference numerals (i.e., based on machine 100). The server machine 100*a* is configured to communicate with the client machine 100*b* over the computer-network 116 (via the communication interfaces 102*a*, 102*b*). Likewise, the client machine 100*b* is configured to communicate with the server machine 100*a* over the computer-network 116. For purposes of this description, any data described as being sent or transmitted by the server machine 100*a* can be data sent by communication interface 102*a* over communication network 116. Similarly, any data described as being sent or transmitted by the client machine 100*b* can be data sent by communication interface 102*b* over communication network 116. Furthermore, for purposes of this description, any data described as being received by the server machine 100*a* can be data the server machine 100*a* receives from the communication network 116 using communication interface 102*a*. Similarly, any data described as being received by the client machine 100*b* can be data the client machine 100*b* receives from the communication network 116 using communication interface 102*b*.

The computer-network 116 for the server-client based configuration described above may take a variety of forms. For example, the computer-network 116 may be a local area network (LAN) in a casino, such that client machines 100*b* dispersed throughout the casino may communicate with the server machine 100*a* in the casino.

In another example, the computer-network 116 may be a wide area network (WAN), such as an Internet network or a network of the World Wide Web. In such a configuration, the client machines 100*b* may communicate with the server machine 100*a* via a website portal (for a virtual casino) hosted on the server machine 100*a*. The data described herein as being transmitted by server machine 100*a* to client machine 100*b* or by client machine 100*b* to server machine 100*a* can be transmitted as datagrams according to the user datagram protocol (UDP), the transmission control protocol (TCP), or another protocol.

The computer-network 116 may include any of a variety of network topologies and network devices, and may employ traditional network-related technologies, including for example the public switched telephone network, cable networks, cellular wireless networks, WiFi, and WiMAX. Further, the computer-network 116 may include one or more databases (e.g., a player credit account database), to allow for the storing and retrieving of data related to performing an outcome event by a machine.

For purposes of this description, any function listed in a sentence including the words the "machine 100 can cause," the "server machine 100*a* can cause," or the "client machine 100*b* can cause" can be carried out, at least in part, as a result of that particular machine executing software program instructions. Those software program instructions can be stored within data storage 114, 114*a*, or 114*b*.

Figure 7:
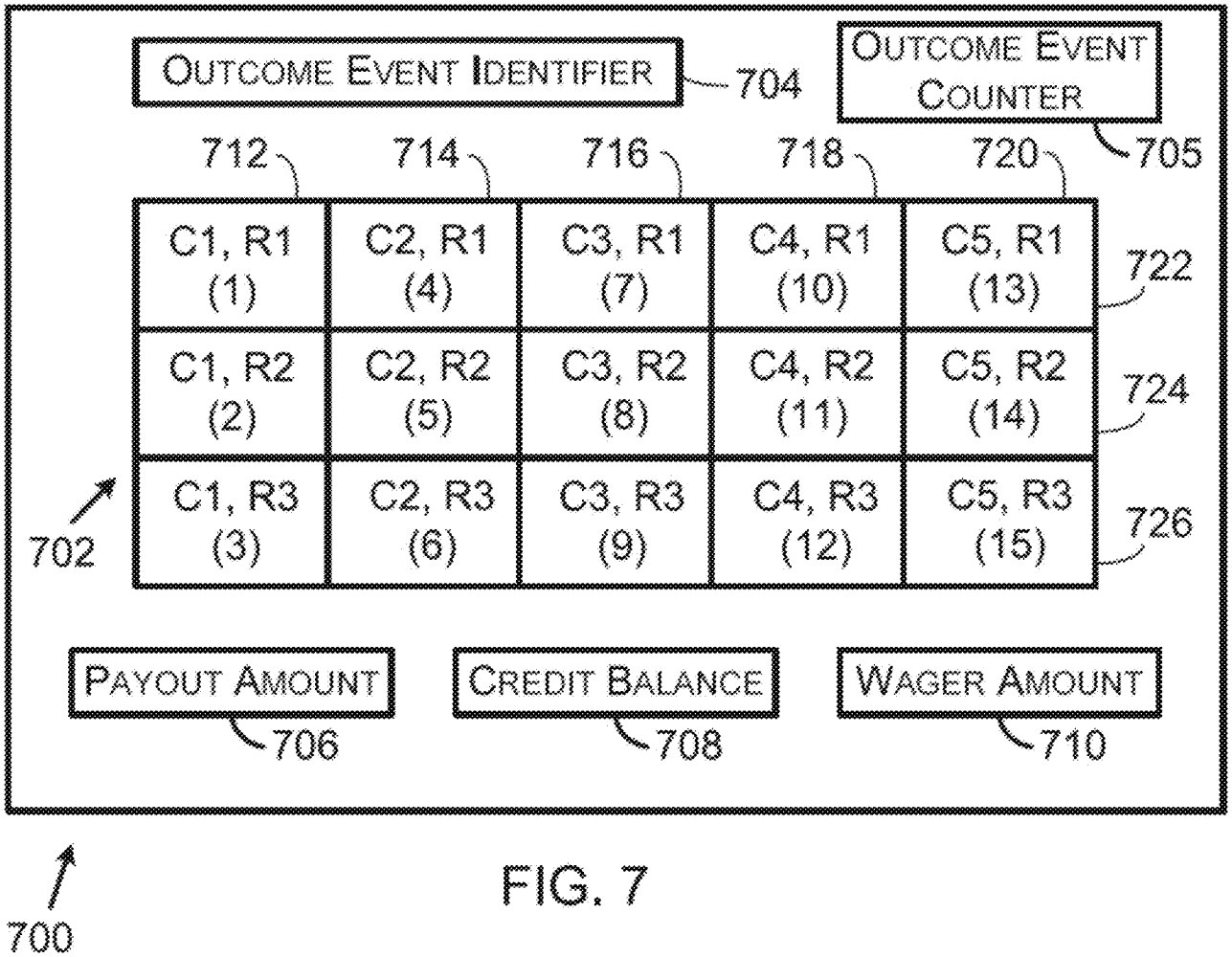
FIG. 7 depicts elements displayable by a display of a machine in accordance with the disclosure.

Next, FIG. 7 depicts a screenshot 700 that machine 100, server machine 100*a*, or client machine 100*b* can visually present (i.e., display) using displays 110, 110*a*, and 110*b*, respectively. For purposes of this description, each element of screenshot 700 can be a displayable element of the display. Screenshot 700 includes a symbol-display-portion 702, an outcome event identifier 704, an outcome event counter 705, a payout amount indicator 706, a credit balance indicator 708, and a wager amount indicator 710.

Symbol-display-portion 702 can include multiple symbol-display-segments and multiple symbol positions. As an example, the symbol-display-segments can include vertical symbol-display-segments 712, 714, 716, 718, and 720 (or more simply, vertical SDS 712-720). As another example, the symbol-display-segments can include horizontal symbol-display-segments 722, 724, and 726 (or more simply, horizontal SDS 722-726). Each symbol-display-segment can include multiple symbol positions. The vertical SDS 712-720 are shown in FIG. 7 as having three symbol positions. The horizontal SDS 722-726 are shown in FIG. 7 as having five symbol positions. A person skilled in the art will understand that those symbol-display-segments can be configured with different numbers of symbol positions than shown in FIG. 7.

The vertical SDS 712-720 can be configured as spinnable reels. The processor of a machine or system displaying screenshot 700 can display the spinnable reels spinning and stopped after spinning For vertical SDS 712-720, the spinnable reels may spin in a vertical direction (e.g., top to bottom or bottom to top, with respect to the symbol-display-portion 702).

The horizontal SDS 722-726 can be configured as spinnable reels. The processor of a machine or system displaying screenshot 700 can display the spinnable reels spinning and stopped after spinning For horizontal SDS 722-726, the spinnable reels may spin in a horizontal direction (e.g., left to right or right to left, with respect to the symbol-display-portion 702).

The multiple symbol positions in symbol-display-portion 702 are identified by column and row designators, in which C1=column 1, C2=column 2, C3=column 3, C4=column 4, C5=column 5, R1=row 1, R2=row 2, and R3=row 3. The multiple symbol positions in symbol-display-portion 702 are also identified by distinct numerical identifiers shown within parenthesis. C1 can be a first SDS. C2 can be a second SDS. C3 can be a third SDS. C4 can be a fourth SDS. C5 can be a fifth SDS. As shown in FIG. 7, C2 is between C1 and C3, C3 is between C2 and C4, and C4 is between C3 and C5.

For a matrix arrangement with 15 symbol positions as shown in FIG. 7, the numerical identifiers can be whole numbers 1 through 15, inclusive. The processors or machines described herein can be configured to select a symbol position of symbol-display-portion 702 using a random number generator that is configured to generate a number within the range 1 through N, inclusive, where N equals the number of symbol positions in symbol-display-portion 702. For the matrix arrangement, each symbol-display segment can be a distinct column of the multiple columns within the matrix. Alternatively, for the matrix arrangement, each symbol-display segment can be a distinct row of the multiple rows within the matrix.

The processor of the machines or systems described herein can determine a state the machine or system is operating in or an outcome event that can occur during the determined state of the machine or system. In response to making that determination, the processor can cause the outcome event identifier 704 to display an identifier of the outcome event that can occur during the determined state. For example, the outcome event identifier can identify a base outcome event, a bonus outcome event or another type of outcome event. The bonus outcome event can be a "Free spins" outcome event or some other outcome event.

The processor of the machines or systems described herein can determine a wager amount placed on an outcome event, a payout amount after or during occurrence of an outcome event resulting in a win, a credit balance after or while decreasing a number of credits based on placement of a wager or after or while increasing a number of credits based on a determined payout amount, and a number of awarded remaining outcome events that can occur. The processor can cause the determined wager amount to be displayed by the wager amount indicator 710, the determined payout amount to be displayed by the payout amount indicator 706, the determined credit balance to be displayed by the credit balance indicator 708, and the number of awarded remaining outcome events to be displayed by the outcome event counter 705.

Figure 8:
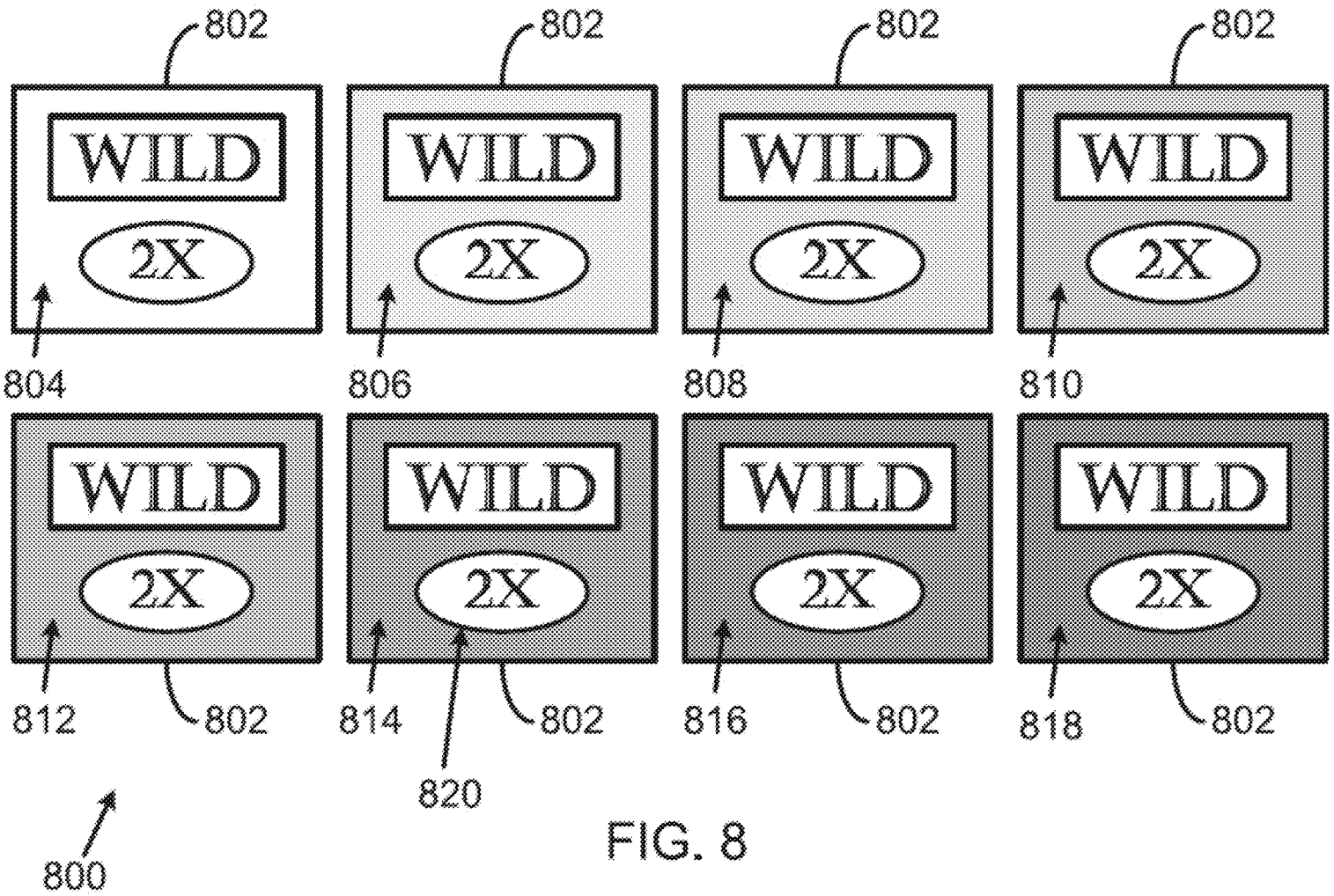
FIG. 8 depicts an example sequence of symbol images displayable by a display to providing a glowing win animation.

Next, FIG. 8 depicts an example sequence 800 of symbol images displayable by a display, such as displays 110, 110*a*, or 110*b*, to provide a glowing win animation. The symbol images of sequence 800 represent a predetermined symbol 802 that can be displayed in a symbol-display-portion 702. A portion of each instance of predetermined symbol 802 in FIG. 8 is a glowing portion with different levels of intensity. The glowing portions are identified with even whole numbers 804 through 818, inclusive. The predetermined symbol includes a multiplier meter 820.

The predetermined symbols can be presented in an order of intensity of the glowing portion of each symbol image from a dimmest intensity (e.g., the dimming intensity of glowing portion 818) to a brightest intensity (e.g., the dimming intensity of glowing portion 804) or from the brightest intensity to the dimmest intensity. As an example, the glowing win animation could include displaying the predetermined sequence with the following repeatable sequence order: 804, 806, 808, 810, 812, 814, 816, 818, 816, 814, 812, 810, 808, 806. As another example, the glowing win animation could include displaying the predetermined sequence with the following repeatable sequence order: 818, 816, 814, 812, 810, 808, 806, 804, 802, 804, 806, 808, 810, 812, 814, 816. A processor 112 can provide the symbol images to display 110 in a desired sequence. A processor 112 can provide the symbol images at a constant rate (e.g., one symbol image every M seconds, where M=0.100 seconds or some other number of seconds). Although, in FIG. 8, the glowing portions are shown in various levels of a gray scale, a person skilled in the art will understand that different levels of intensity of other color could be displayed in the glowing portions instead. The person skilled in the art will also understand that the number of images in the sequence could be an number greater than or equal to two.

Figure 9:
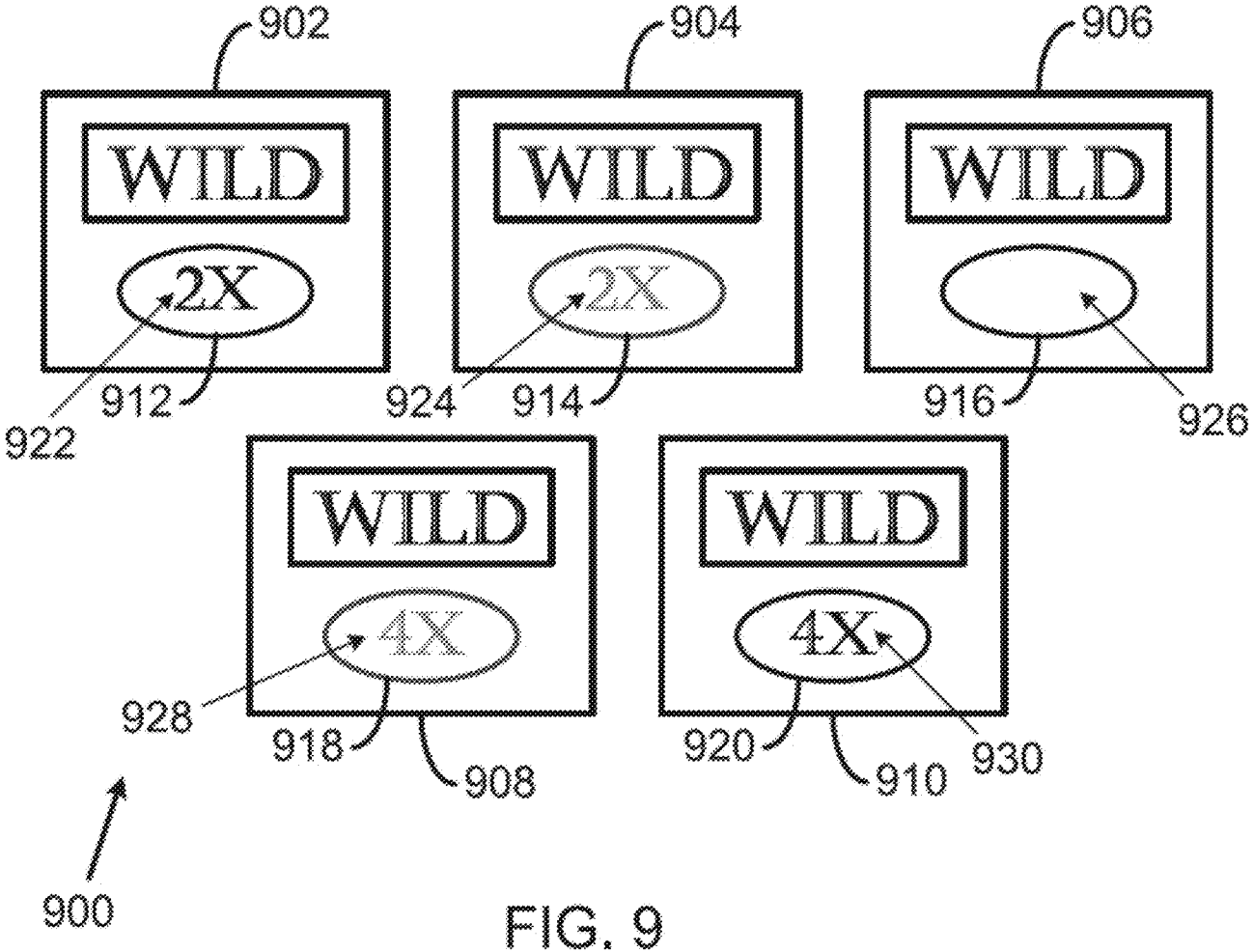
FIG. 9 depicts an example sequence of symbol images displayable by a display to provide cross-fading of a multiplier value or a multiplier meter within a symbol.

Next, FIG. 9 depicts an example sequence of symbol images 900 (or more simply, the "sequence 900") displayable by displays 110, 110*a*, and 110*b* or another display to provide (i.e., display) cross-fading of a multiplier value or a multiplier meter within a predetermined symbol. The sequence 900 includes symbol image 902, 904, 906, 908, and 910 including multiplier meters 912, 914, 916, 918, and 920, respectively. Multiplier values 922, 924, 926, 928, and 930 are shown within multiplier meters 912, 914, 916, 918, and 920, respectively.

Cross-fading the multiplier value or multiplier meter, as shown in FIG. 9, can include the display displaying images of the predetermined symbol in a sequence such that (i) a multiplier value 922 is initially displayed with a least amount of fading (e.g., 0 percent fading), (ii) the multiplier value is displayed as it dims from the least amount of fading to a greatest amount of fading (e.g., 100 percent fading), (iii) a multiplier value is displayed at it brightens from the greatest amount of fading to the least amount of fading, and (iv) a multiplier value 930 is displayed with the least amount of fading. A multiplier value 926 displayed with the greatest amount of fading may appear as shown in multiplier meter 916.

For item (ii) of the cross-fading operation described above, a multiplier value may be displayed with one or more intermediate values of fading such that each intermediate value of fading is within the range: 0 percent fading<intermediate percentage value of fading<100 percent fading, and such that any subsequently displayed intermediate value of the one or more intermediate values of fading has a greater amount of fading than a prior displayed intermediate value of the one or more intermediate values while dimming the multiplier value. The sequence 900 shows multiplier value 924 being displayed with an intermediate amount of fading (e.g., 50 percent fading).

For item (iii) of the cross-fading operation described above, a multiplier value may be displayed with one or more intermediate values of fading such that each intermediate value of fading is within the range: 100 percent fading<intermediate percentage value of fading<0 percent fading, and such that any subsequently displayed intermediate value of the one or more intermediate values of fading has a lesser amount of fading than a prior displayed intermediate value of the one or more intermediate values while brightening the multiplier value. The sequence 900 shows multiplier value 928 being displayed with an intermediate amount of fading (e.g., 50 percent fading).

A first multiplier value (e.g., 2×) may be displayed as the multiplier value dims in the sequence 900 for a given bonus outcome event. A second multiplier (e.g., 4×), selected by a machine for the bonus outcome event, can replace the first multiplier value during the time when the first multiplier value is being displayed with the greatest amount of fading. A glowing win animation, such as sequence 800, and a cross-fading of a multiplier value or meter, such as sequence 900, can occur with a common predetermined symbol simultaneously.

III. Example Operation

Figure 3A:
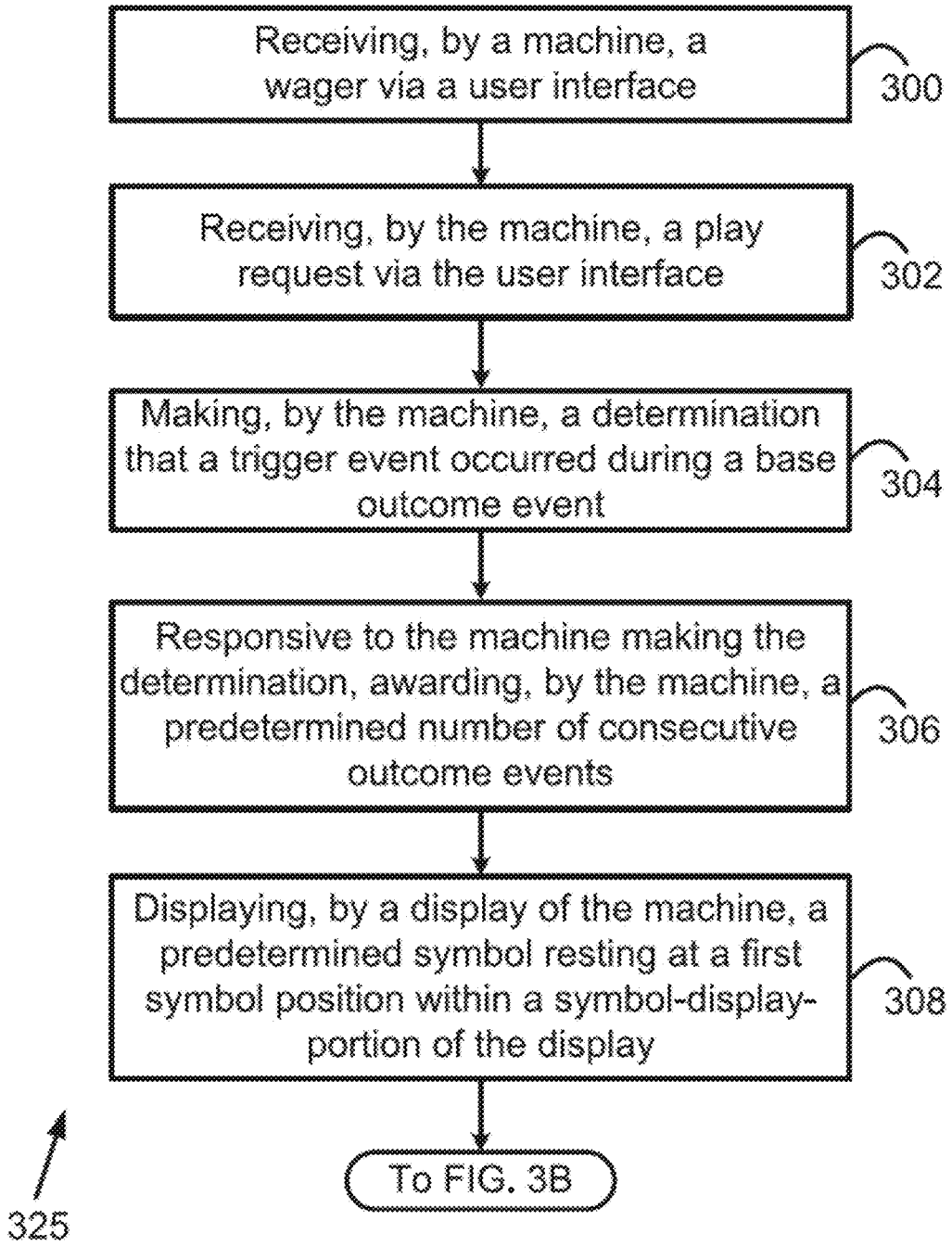
FIG. 3A is a first part of a flow chart showing functions in accordance with a method in an embodiment of the disclosure.
Figure 3B:
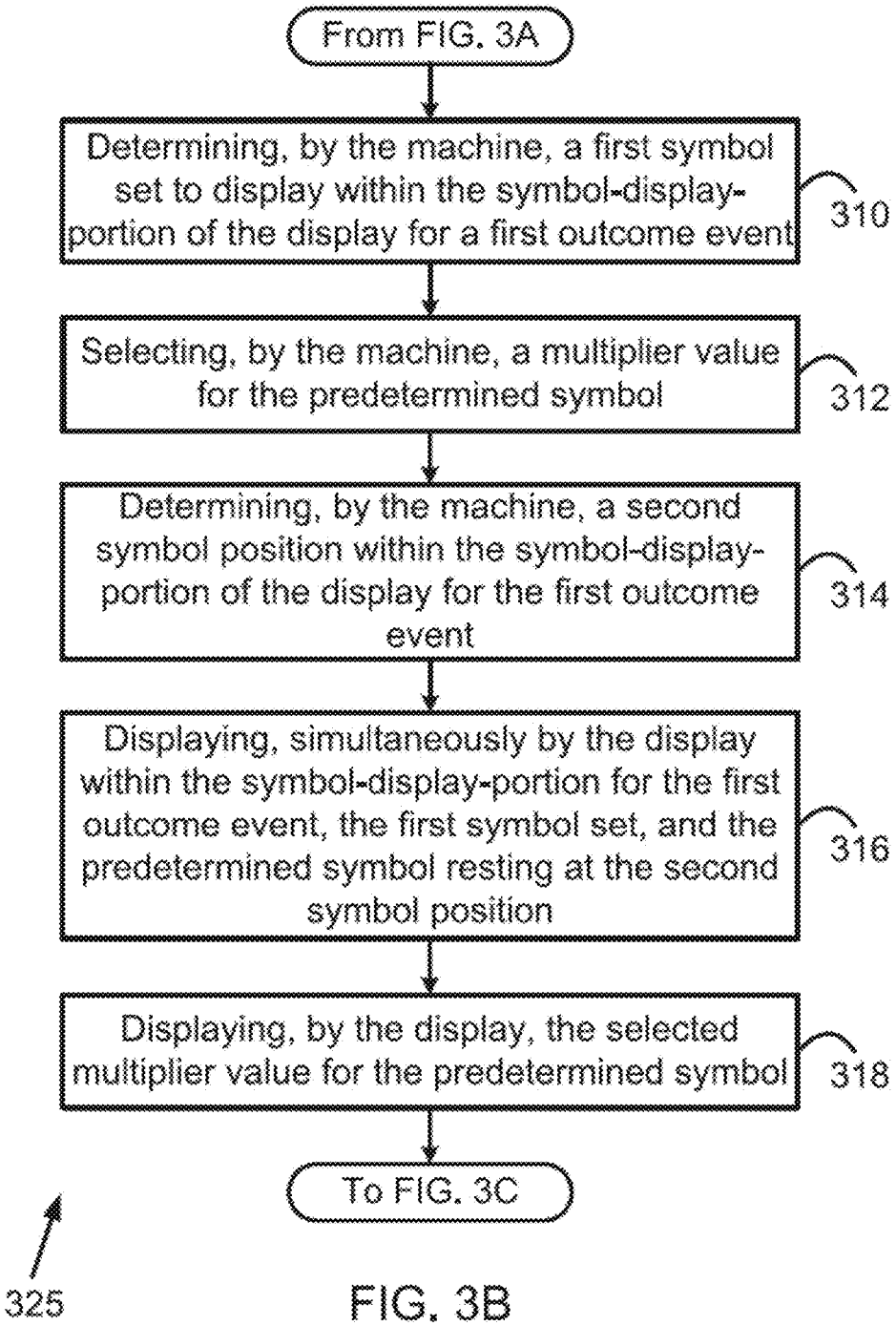
FIG. 3B is a second part of the flow chart of FIG. 3A.
Figure 3C:
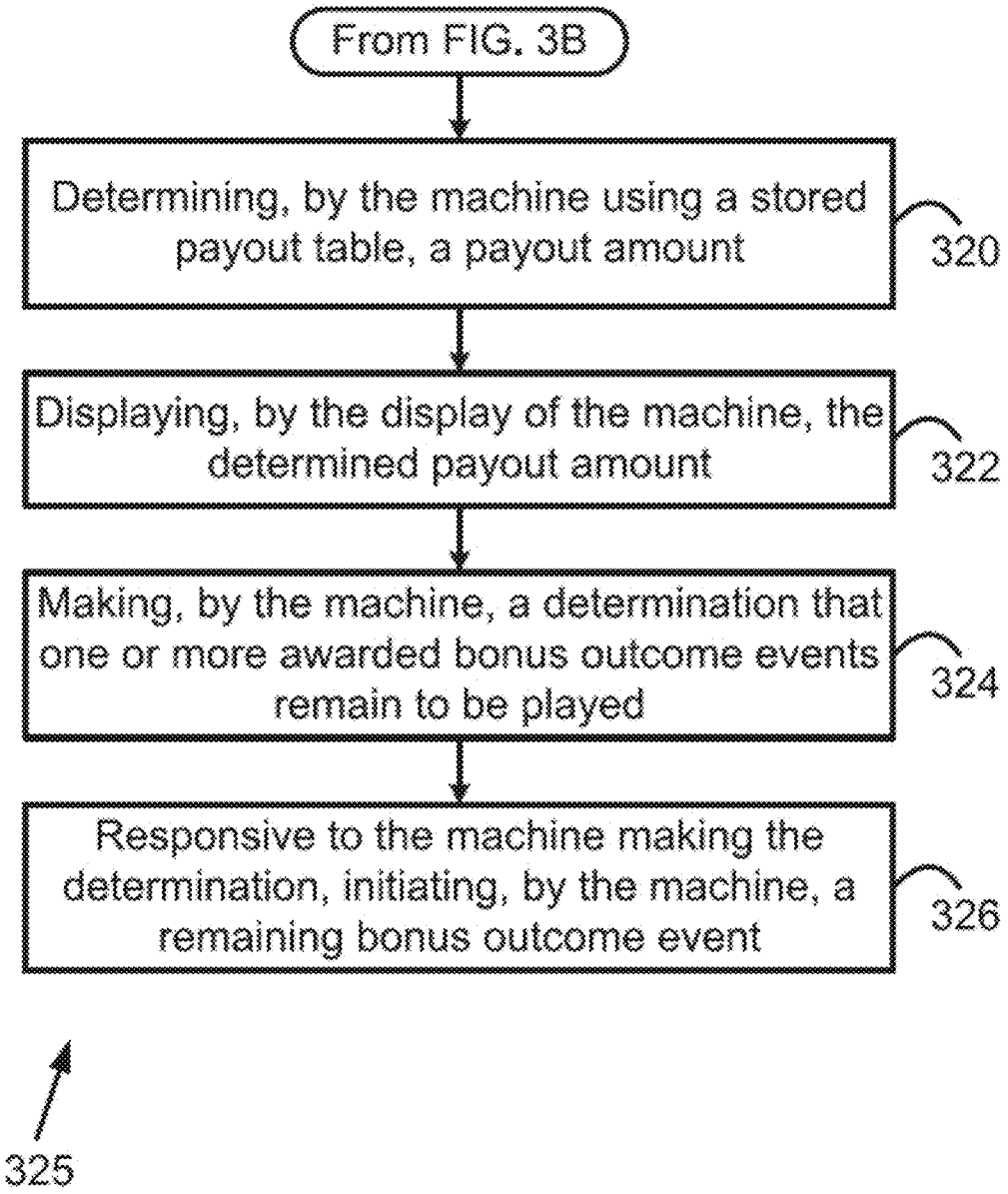
FIG. 3C is a third part of the flow chart of FIG. 3A.

FIG. 3A, FIG. 3B and FIG. 3C (i.e., FIG. 3A-3C) depict a flowchart showing a set of functions (e.g., operations) 325 (or more simply, "the set 325") that can, for example, be carried out using machine 100. The functions of the set 325 are shown within blocks labeled with even integers between 300 and 326, inclusive, and can pertain to a method in connection with machine 100. The example method can relate to performing outcome events, such as a wager game. Any other function(s) described herein as being performed by machine 100 can be performed prior to, while, or after performing any one or more of the functions of the set 325, unless context clearly dictates otherwise. Those other function(s) can be performed in combination with or separately from any one or more of the functions of the set 325. Any function described below, or elsewhere in this description, with respect to FIG. 3A, FIG. 3B or FIG. 3C, can be performed, at least in part, by a processor, such as processor 112 executing software program instructions.

Block 300 includes receiving, by machine 100, a wager via the user interface 104. In one example, this may allow a player to enter a wager (e.g., a wager amount) using a keypad of the user interface 104. The wager can be placed on an outcome event, such as, but not limited to, a base outcome event configured as a wager game. The received wager may or may not provide a user of the machine with an opportunity to earn (e.g., win) a payout. Since a received wager does not necessarily provide an opportunity to earn a payout, the received wager can be referred to as a payment. A base outcome event can be carried out after or in response to receiving a payment. Machine 100 can be configured such that a bonus outcome event can be carried out without receiving any additional payment after receiving a payment to carry out a base outcome event that results in an award of a predetermined number of bonus outcome events.

A player using machine 100 may have a corresponding player credit balance from which the entered wager may be deducted in response to the wager being entered or machine 100 receiving a play request from the player. For example, a player may have a player credit balance of 100,000 credits, which may be reduced to 99,750 credits upon the player requesting a play of the game with a wager of 250 credits. Additionally, or alternatively, the wager can be received by entry of a token, coin, or paper bill into the user interface 104 or by sliding or inserting a payment card, such as a credit or debit card, into the user interface 104. Machine 100 can cause display 110 to display wager information such as, but not limited to, a player credit balance on the credit balance indicator 708, possible wager amounts in wager amount indicator 710, and a received wager amount in wager amount indicator 710.

Next, block 302 includes receiving, by machine 100, a play request (e.g., a "spin" request) via the user interface 104. Receiving the play request can include or allow a player to pull a lever or push a button on machine 100 to initiate occurrence of an outcome event or to request a play of the wager game. Receiving the play request can result in the player's credit balance being reduced by an amount of the player's wager or a payment to carry out the outcome event.

Next, block 304 includes making, by machine 100, a determination that a trigger event occurred. The trigger event can be a randomly occurring event, such an event that randomly occurs during performance of at least some base outcome events. For example, occurrence of the trigger event can include machine 100 selecting, using a random process, a trigger symbol from a group of symbols, such as in connection with a previous play of the game (e.g., a base outcome event). In another example, occurrence of the trigger event can include machine 100 selecting a trigger symbol for display in a particular arrangement position (e.g., in a middle row or a middle column). As yet another example, the trigger event can include machine 100 selecting, using a random number generator, a number in response to machine 100 receiving the play request, where the selected number is a trigger number. As still yet another example, the trigger event can include machine 100 displaying a particular combination of symbols selected from a global symbol set. Note that while a few example trigger events have been described above, any of a variety of other trigger events could be used to suit a desired configuration.

Making the determination that the trigger event occurred can occur while machine 100 operates in a first machine state (or more simply, the first state). Machine 100 can be configured such that, while machine 100 is operating in the first state, machine 100 allows the player to play base outcome events in which sets of symbols selected from a global symbol set can be selected by processor 112 and displayed by display 110, but a predetermined symbol displayable for bonus outcome events is not displayable by display 110.

Next, block 306 includes, responsive to machine 100 making the determination (i.e., the determination made at block 304), awarding, by machine 100, a predetermined number of consecutive plays (e.g., spins) of outcome events. The awarded outcome events can be bonus outcome events, such as a game or a wager game. The predetermined number of consecutive outcome events can be conditioned upon a combination of symbols displayed by display 110 as a result of playing a base outcome event. Machine 100 can cause outcome event identifier 704 to identify the bonus outcome event awarded (e.g., a "Free spins" bonus) and to cause the outcome event identifier 705 to display the predetermined number.

Furthermore, in response to making the determination at block 304, machine 100 can transition from operating in the first state to operating in a second machine state (or more simply, the second state). Machine 100 can be configured such that, while machine 100 is operating in the second state, machine 100 allows the player to play bonus outcome events in which sets of symbols selected from a global symbol set can be selected by processor 112 and displayed by display 110, and a predetermined symbol displayable for bonus outcome events is displayable by display 110 along with symbols from the selected symbol set. In accordance with an embodiment in which the symbol-display-portion includes 15 symbol positions, selecting a set of symbols for a bonus outcome event can include selecting 15 symbols, and the selected predetermined symbol can cover one of those 15 symbols. In another embodiment, selecting the set of symbols can include selecting 14 symbols and the predetermined symbol can positioned in a symbol position at which the 14 symbols are not to be positioned for the first outcome event.

Machine 100 can be configured to transition from operating in the second state back to operating in the first state. This transition can occur in response to machine 100 determining any of a variety of trigger events, such as, but not limited to, occurrence of all of the awarded predetermined number of consecutive plays of the outcome event or a player stopping play of machine 100 while one or more of the awarded predetermined number of consecutive plays of the outcome event remain to occur. Machine 100 can be configured to store a number indicating any remaining consecutive plays of the outcome event and to allow a player awarded the consecutive plays to commence playing any remaining consecutive plays of the outcome event at a time after the player stops performing (e.g., playing) the outcome events.

Next, block 308 includes displaying, by display 110 of machine 100, a predetermined symbol resting at a first symbol position within a symbol-display-portion 702 of display 110. In one respect, the predetermined symbol can be the only predetermined symbols used for bonus outcome events. In another respect, the predetermined symbol can be selected for display at the first symbol position by processor 112 selecting the predetermined symbol from among multiple symbols that can be used as the predetermined symbol described in this description.

The predetermined symbol can comprise a multiplier meter configured to display a multiplier value. The multiplier value can be selected by processor 112 for displaying by or within a multiplier meter using any method described herein or by another method. Examples of multiplier meters are shown in FIG. 5, FIG. 6, FIG. 8, and FIG. 9.

Displaying the predetermined symbol resting at the first symbol position can occur as a response to machine 100 awarding a predetermined number of bonus outcome events. As an example, the predetermined number of bonus outcome events can equal five. For purposes of this description, the five bonus outcome events are numbered, in an order of occurrence, as #1, #2, #3, #4, and #5. If machine 100 is displaying the predetermined symbol prior to initiating or as part of bonus outcome event #1, the first symbol position can be a non-randomly selected symbol position, such as symbol position (8) at column 3, row 2, as shown in FIG. 7. If machine 100 is displaying the predetermined symbol prior to initiating or as part of any bonus outcome event after the earliest occurring bonus outcome event of a series of awarded bonus outcome events (e.g., bonus outcome events #2, #3, #4 or #5), the first symbol position can be a randomly selected symbol position from among the symbol positions of symbol display-portion 702.

Turning to FIG. 3B, block 310 includes determining, by machine 100, a first symbol set to display within the symbol-display-portion 702 of display 110 for a first outcome event. The first outcome event can be an earliest occurring outcome event of a predetermined number of awarded outcome events or any subsequent outcome event of those awarded outcome events. Determining the first symbol set can include processor 112 carrying out a random selection, such as a random selection of the first symbol set from the global symbol group.

Figure 5:
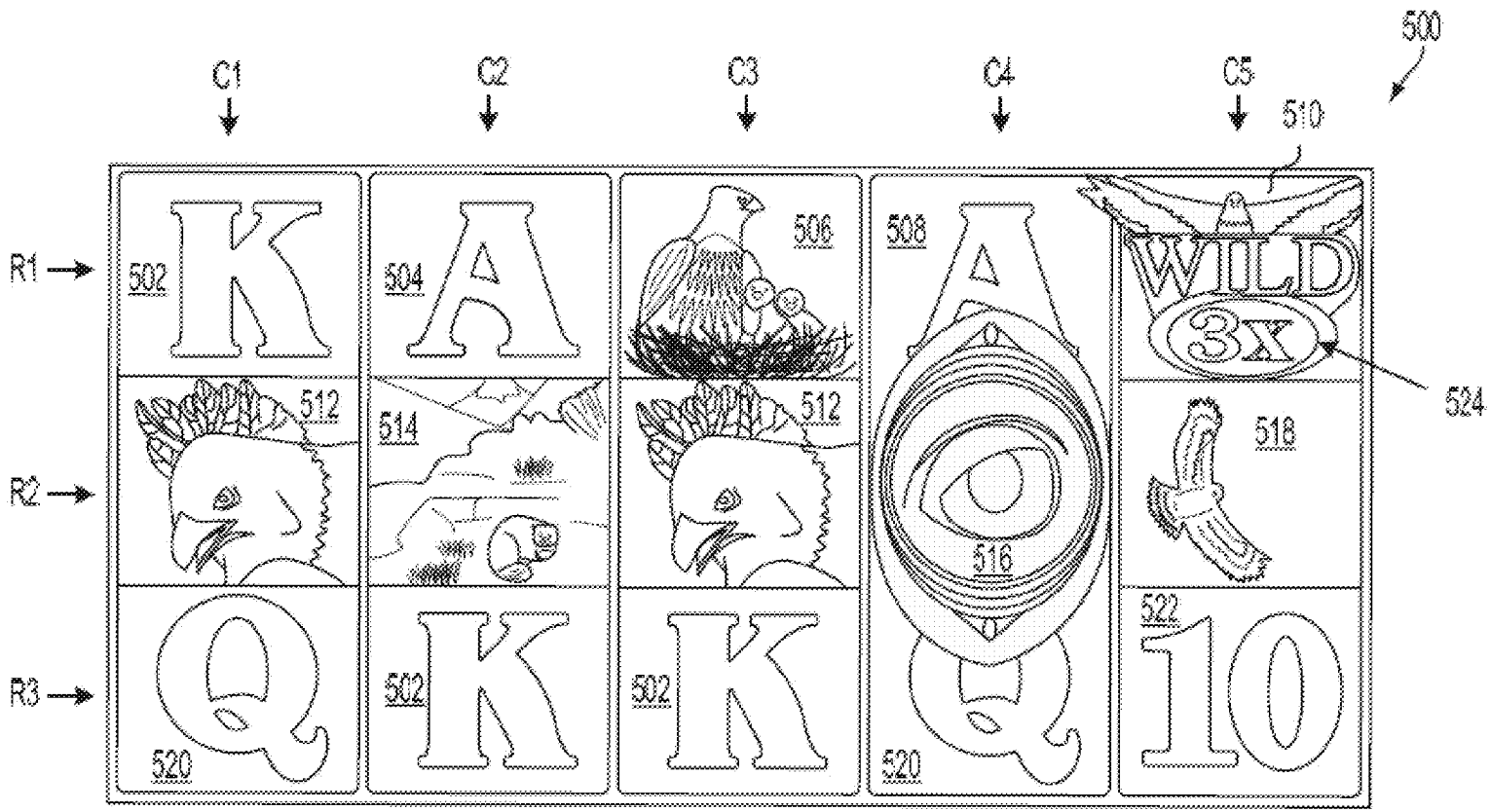
FIG. 5 depicts an example of a selected symbol set displayed by a display in accordance with the embodiments of the disclosure.
Figure 6:
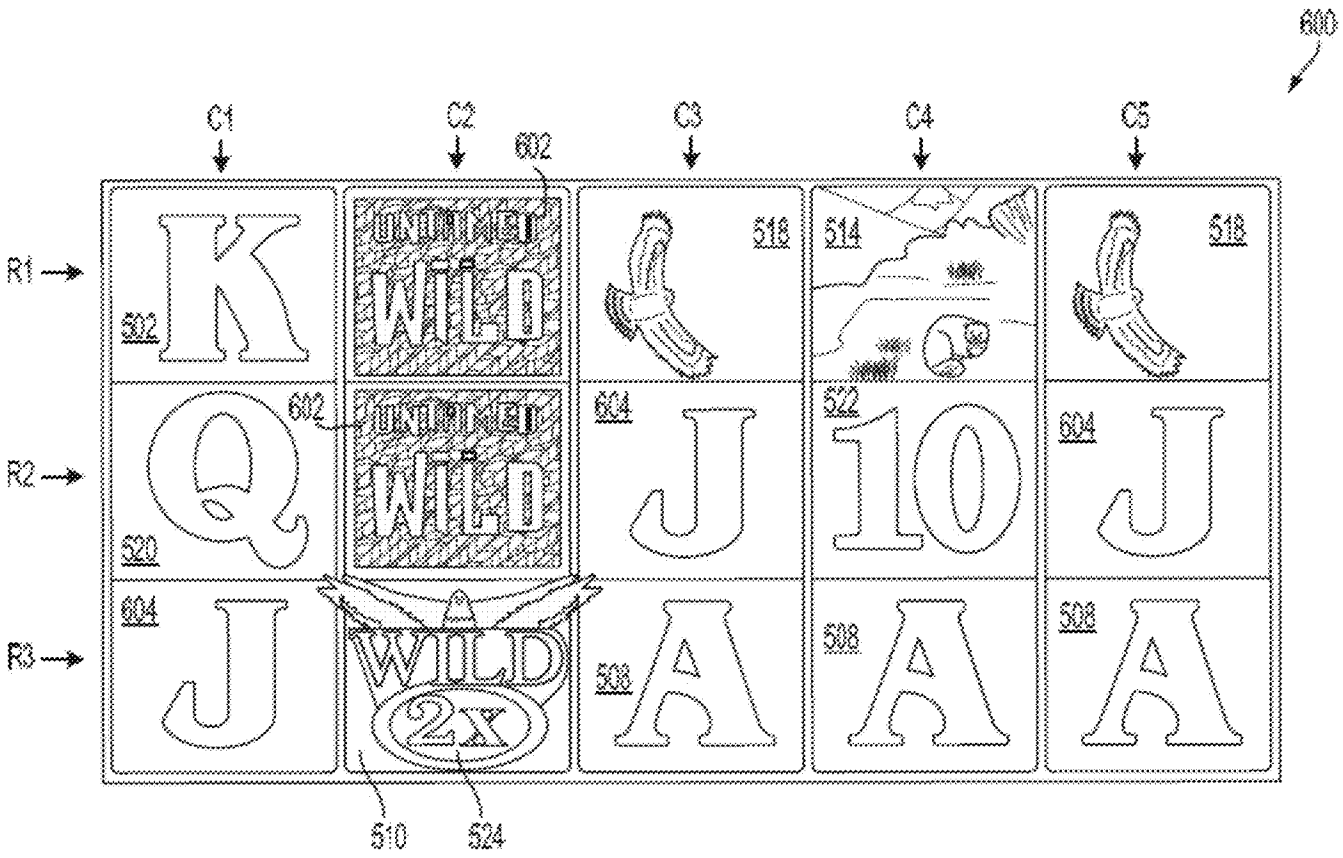
FIG. 6 depicts an example of another selected symbol set displayed by a display in accordance with the embodiments of the disclosure.

The global symbol group can include multiple symbols, such as an Eagle, a Wild, an Ace, a King or a Queen, that may be used in connection with the outcome event, such as a wager game. The Ace, King, and Queen symbols can represent symbols found on a standard deck of playing cards. FIG. 5 and FIG. 6 depict examples of the aforementioned symbols and examples of other symbols that can be a part of the global symbol group. In FIG. 6, the Wild symbol 602 (shown using the text "Untamed Wild") is shown in two distinct symbol positions. The global symbol group may be customized with particular symbols as desired.

The global symbol group can include one or more no-cover symbols. A no-cover symbol is a symbol that machine 100 will not cover with the predetermined symbol. In other words, the predetermined symbol cannot rest upon a no-cover symbol. As an example, a Wild symbol (e.g., a Wild symbol 602 of FIG. 6) or some other symbol can be selected or defined as a no-cover symbol. The predetermined symbol can pass over a no-cover symbol as the predetermined symbol moves along a path from a first symbol position to a second symbol position.

In one respect, no portion of the predetermined symbol will cover any portion of a no-cover symbol. In another respect, one or more portions of the predetermined symbol can cover a portion of the no-cover symbol or a portion of another symbol of the global symbol set, but the symbol covered by a portion of the predetermined symbol does not change with respect to determining a payout for the outcome event in which the covered symbol is displayed. FIG. 6 depicts an example predetermined symbol 510 (i.e., a Wild symbol with a multiplier meter 524 and a bird with its wings expanded). A portion of the expanded wings cover a portion of an adjacent Jack symbol 604 and another portion of the expanded wings cover a portion of an adjacent Ace symbol 508. Any defined payline including Jack symbol 604 at C1, R3, uses Jack symbol 604 to determine whether a payout is earned. Similarly, any defined payline including Ace symbol 508 at C3, R3, uses Ace symbol 508 to determine whether a payout is earned.

Figure 4:
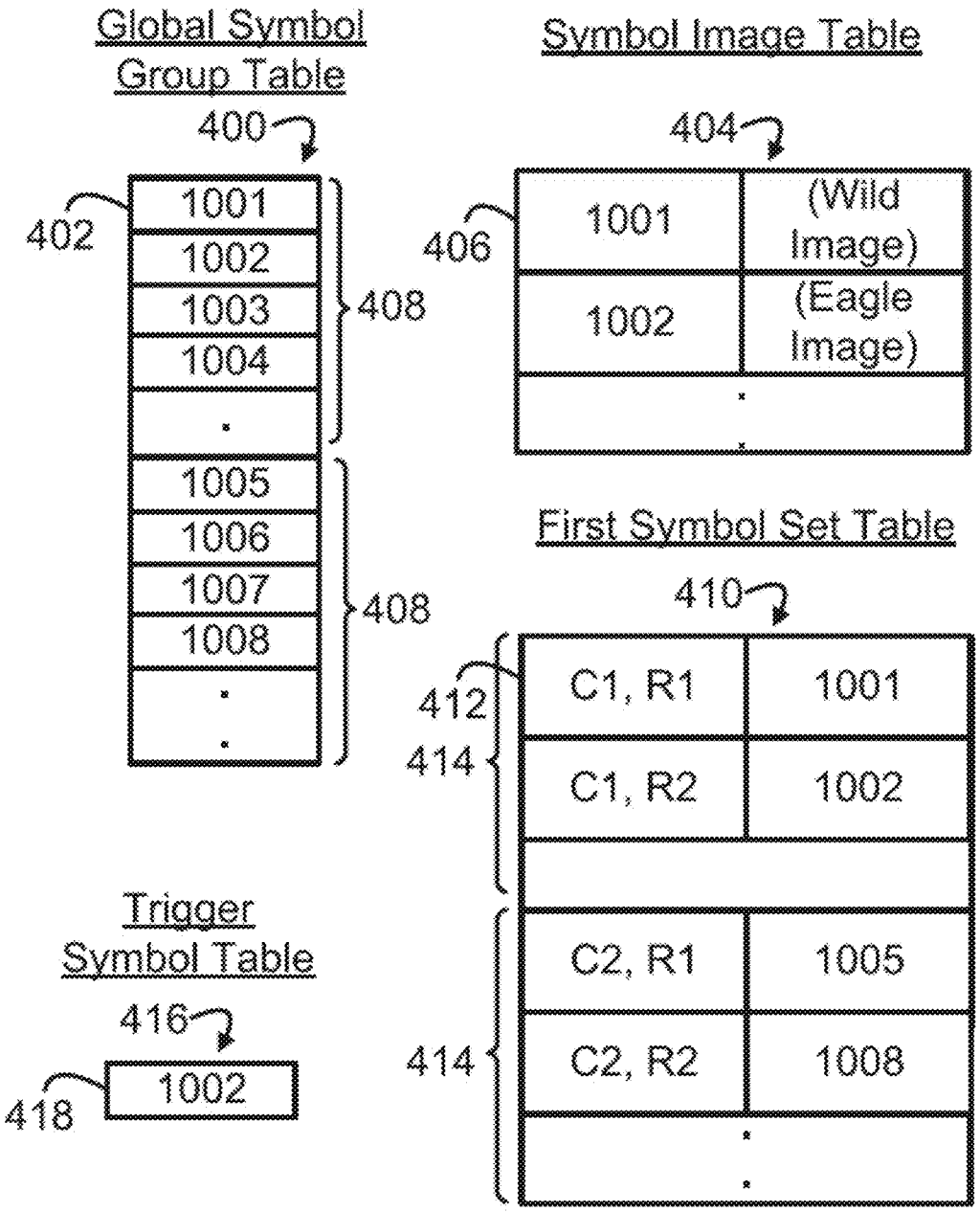
FIG. 4 depicts diagrams of tables used in accordance with machines and methods in embodiments of the disclosure.

In one example, the global symbol group may be represented as a table (or other data structure) stored in data storage 114. FIG. 4 shows an example global symbol group table 400. The global symbol group table 400 includes multiple records 402, each including an identifier (e.g., 1001, 1002, 1003 1004, etc.) that represents a particular symbol. In one example, the global symbol group, and therefore the global symbol table 400, may be divided into multiple sub-groups 408 as discussed in greater detail below.

The global symbol group table 400 may be used in connection with a symbol image table 404. The symbol image table 404 includes multiple records 406 (shown as distinct rows of table 404), each including an identifier that represents a particular symbol, and a corresponding displayable image. As such, the symbol image table 404 may be used to map an identifier in the global symbol group table 400 to a displayable image.

The selected first symbol set may be represented by a first symbol set table 410. The first symbol set table 410 includes multiple records 412 (shown as distinct rows in table 410), each record including an arrangement position of the symbol, and an identifier that represents the symbol. As such, each symbol in the selected first symbol set may correspond with a respective arrangement position in an arrangement (e.g. both a column number and a row number in a column-and-row arrangement). As an example, C1, R1, shown in the first symbol set table 410, represents a symbol position at column 1 (e.g., a left-most column of a plurality of columns in a symbol-display-portion 702 of display 110) and row 1 (e.g., at top row of a plurality of rows in a symbol-display-portion 702 of display 110). The column identifiers in table 410 (e.g., C1 and C2) can refer to columns in a symbol matrix or reels of a plurality of reels that can be spun.

In one example, machine 100 may select the first symbol set by iterating through each record 412 in the first symbol set table 410, and selecting a symbol identifier from among the symbol identifiers in the global symbol group table 400. In one example the symbol identifiers are numbers and machine 100 uses a random number generator to select such numbers, and therefore to randomly select symbols.

In one example, machine 100 may select each subset in the first symbol set from the corresponding sub-group in the global symbol group. This type of selection may be used when the symbol set represents one or more reels in a reel-type wager game. In this instance, each sub-group includes all the symbols of a given reel, and the selected sub-set includes the symbols of the reel that are "in play", namely those included in the selected first symbol set.

In one example, the first symbol set may be partially restricted. For instance, the first symbol set may include an instance of a predetermined symbol from the global symbol group, for example, a Wild symbol. In another example, the predetermined symbol may be in a subgroup of global symbol group table 400 distinct from the subgroups from which symbols for the reels are selected.

The arrangement position of the predetermined symbol in the first symbol set may be unrestricted. For instance, the predetermined symbol can rest upon any symbol located at any symbol position. Alternatively, the arrangement position of the predetermined symbol in the symbol set may be restricted, such as restricting the predetermined symbol from resting on a no-cover symbol selected as part of the first symbol set.

As noted above, for each symbol in the selected first symbol set, the example embodiments can include machine 100 randomly determining a corresponding arrangement position. As such, in an example where the arrangement is a column-and-row arrangement, machine 100 may randomly determine a column identifier and a row identifier (from a set of potential column identifier and row identifier combinations) for each symbol in the selected first symbol set. In an example where the arrangement has symbol position identifiers (e.g., whole number 1 through 15, inclusive, as described above), machine 100 may randomly select a symbol position identifier for each symbol in the selected first symbol set.

Next, block 312 includes selecting, by machine 100, a multiplier value for the predetermined symbol. Processor 112 can execute program instructions to select the multiplier value from among a plurality of multiplier values. The plurality of multiplier values can, for example, include a smallest multiplier value and a greatest multiplier value. That plurality of multiplier values can, for example, also include at least one intermediate multiplier value having a value greater than the smallest multiplier value and less than the greatest multiplier value. As an example, the smallest multiplier value can be a 2× multiplier, the greatest multiplier value can be a 10× multiplier, and the at least one multiplier values can include a 3× multiplier value, a 4× multiplier value, and a 5× multiplier value. Using a multiplier value, can include multiplying a base payout amount by a number preceding the × in the multiplier value (e.g., multiplying the base payout amount by 5 when the multiplier value is 5×).

Selection of the multiplier value can be conditioned on which symbol-display segment includes the second symbol position. For example, if SDS 712, 714 or 716 includes the second symbol position, then selecting the multiplier value can comprise selecting any of the defined multiplier values (e.g., 2×, 3×, 4×, 5×, and 10×), and if SDS 718 or 720 includes the second symbol position, then selecting the multiplier value can comprise selecting a sub-set of the defined multiplier values (e.g., 2×, 3× and 4×, but not 5× and 10×).

Next, block 314 includes determining, by machine 100, a second symbol position within the symbol-display-portion of the display 110 for the first outcome event. In one example, the second symbol position is also the first symbol position. In another example, the second symbol position is different than the first symbol position. In another example, the second symbol position is within an SDS that includes the first symbol position or is within another SDS. Processor 112 can execute program instructions to determine the second symbol position by selecting the second symbol position using a random process. In other words, processor 112 can carry out a second random selection to select the second symbol position (the first random selecting resulting in selection of the first symbol set). For instance, the processor 112 may use a random number generator to select a number (e.g., a number within the range of whole numbers 1 through 15, inclusive) associated with a symbol position.

In one respect, processor 112 can determine the second symbol position after determining the first symbol set and determining that the first symbol set does not include any no-cover symbols or determining that the first symbol set includes a no-cover symbol and the position of the no-cover symbol and selecting any symbol position other than the position for the no-cover symbol as the second symbol position.

Selecting the multiplier value (at block 312) can be conditioned upon which symbol-display segment comprises the second symbol position (determined at block 314).

Next, block 316 includes displaying, simultaneously by the display 110 within the symbol display-portion for the first outcome event, the first symbol set, and the predetermined symbol resting at the second symbol position. In one example, machine 100 may display the first symbol set on display 110 by displaying the displayable image associated with each symbol in the selected first symbol set (e.g. according to the symbol image table 404).

FIG. 5 shows an example of a first symbol set 500 selected from the global symbol group for display during a bonus outcome event. As described above, the bonus outcome event can be initiated pursuant to machine 100 making a determination that one or more of the awarded outcome events have not yet occurred (i.e., remain to occur). The displayed first symbol set 500 includes a single predetermined symbol (i.e. the Wild symbol) 510 at position C5, R1 in the arrangement that includes columns C1 through C5 and rows R1 through R3. The displayed predetermined Wild symbol 510 includes a multiplier meter 524 with a multiplier value 3× within the multiplier meter 524.

The first symbol set 500 also includes: (i) three King symbols 502 at symbol or arrangement positions C1, R1 and C2, R3, and C3, R3, (ii) two Ace symbols 504 at symbol or arrangement positions C2, R1 and C4, R1, (iii) an eagle family symbol 506 at symbol or arrangement position C3, R1, (iv) an eagle close-up symbol 512 at symbol or arrangement positions C1, R2 and C3, R2, (v) a beaver symbol 514 at symbol or arrangement position C2, R2, (vi) a scatter symbol 516 centered at symbol or arrangement position C4, R2, (vii) a soaring eagle symbol 518 at symbol or arrangement position C5, R2, (viii) two Queen symbols 520 at symbol or arrangement positions C1, R3 and C4, R3, and (ix) a ten symbol 522 at symbol or arrangement position C5, R3.

Where the column and row arrangement is used to simulate reels, machine 100 may display the each sub-set in a corresponding column, such as by superimposing each sub-set over a virtual reel in a corresponding column.

Next, block 318 includes displaying, by the display 110, the selected multiplier value for the predetermined symbol in the selected first symbol set. Displaying the selected multiplier value can include displaying the multiplier value while the predetermined symbol moves along at least a portion of a path from the first symbol position to the second symbol position or while the predetermined symbol position is displayed resting at the second symbol position for the first outcome event.

Turning to FIG. 3C, block 320 includes determining, by machine 100 using a stored payout table, a payout amount. The payout table can be stored in data storage 114. The payout table can define multiple symbol combinations and base payout amounts. Table 1 below includes example data that can be stored within the payout table. In Table 1, the multiple symbol combinations include a symbol for each column in a five column matrix arrangement. For a reel type game, the column numbers in Table 1 can refer to reel numbers. A winning symbol combination can be defined for a number of symbols other than five symbols. A Wild symbol located at any given symbol position can take the place of any symbol defined for the given symbol position in any winning symbol combination. As an example, the base payout value can represent a number of credits or an amount of currency.

TABLE 1

| Column 1 | Column 2 | Column 3 | Column 4 | Column 5 | Base Payout |
|---|---|---|---|---|---|
| Ace | King | Queen | Jack | Ten | 100 |
| Ace | Ace | Ace | Ace | King | 75 |
| King | King | Queen | Queen | Queen | 65 |

Processor 112 can execute program instructions to determine whether a payout is earned (e.g., won) as a result of each outcome event occurring at machine 100. If a payout is not earned, the payout amount can be zero. If a payout is earned, the payout amount can be a function of the received wager and the symbol set selected for the outcome event (e.g., the first symbol set selected for the first outcome event) or the corresponding arrangements of symbols in the selected first symbol set.

To determine a payout amount, a base payout amount may be multiplied by the selected multiplier associated with the predetermined symbol (e.g., the single predetermined Wild symbol 510 of FIG. 6) in the selected first symbol set. That base payout amount can be the base payout amount associated with a symbol combination located on a payline selected or being used for the outcome event. Machine 100 can be configured to use the multiplier value within the predetermined symbol to determine the payout amount only if the displayed predetermined symbol is within the payline associated with the determined payout amount. Additionally or alternatively, machine 100 can be configured to use the multiplier value within the displayed predetermined symbol to determine the payout amount for each payline selected or being used for the outcome event even if the predetermined symbol is not within the payline.

In one example, machine 100 may also physically dispense a corresponding payout (e.g., cash), or otherwise facilitate the payout to the player (by adding funds to an electronic account associated with a gaming card). Additionally or alternatively to determining the payout amount, machine 100 may perform other actions to award the player. For instance, the machine may display an indication of a tangible prize. Other types of awards may be used as well.

Next, block 322, includes displaying, by display 110 of machine 100, the determined payout amount. For example, where machine 100 has determined, using the stored payout table, a payout amount of 500 credits, machine 100 may display on display 110 the determined payout amount of 500 credits. Additionally or alternatively, machine 100 may add the determined payout amount to the player credit balance and display the updated player credit balance. For instance, where the player credit balance was 99,750 credits before the payout amount was determined, machine 100 may add the determined payout amount of 500 credits to the player credit balance so that the updated balance is 100,250 credits. Furthermore, machine 100 can cause display 110 to display a count-up from a first balance amount (e.g., 99,750 credits) to a second balance amount (e.g., 100,250 credits), where the second balance amount equals a sum of the first balance amount and the determined payout amount.

The method may also include machine 100 displaying on display 110 an indication of the predetermined Wild symbol in the selected first symbol set. In one example, machine 100 may display such an indication by highlighting, shading, hatching or adding a border around the predetermined Wild symbol, but other indication techniques may be used. In that example or another example, the display 110 may display a glowing win animation within the predetermined Wild symbol. The glowing win animation may occur during the display of a payout count-up. The glowing win animation can occur as described with respect to FIG. 8, but is not so limited.

In one example, machine 100 selecting the arrangement position of the predetermined Wild symbol in the selected symbol set occurs before the machine selecting the remainder of the first symbol set. However, machine 100 may also select the arrangement position of the predetermined Wild symbol at the same time as or after selecting the first symbol set.

In one example where the outcome event emulates a reel-type game, display 110 shows the predetermined symbol (e.g., a predetermined Wild symbol) moving along a path while the game simulates a spin of the reels. This may give the appearance to the player that position of the predetermined Wild symbol is being randomly determined. For instance, the predetermined Wild symbol may move up, down, left and right over the arrangement until it eventually "locks" into place or comes to rest in a particular arrangement position for the first outcome event.

Next, block 324 includes making, by machine 100, a determination that one or more of the awarded bonus outcome events remain to be played. In that regard, processor 112 may determine that one or more awarded bonus outcome events have not occurred. In response to making that determination, processor 112 can execute program instructions to determine a next symbol set (e.g., a second symbol set as described elsewhere in this description), and a next symbol position (e.g., a third symbol position as described elsewhere in this description).

Next, block 326 includes, responsive to machine 100 making the determination (i.e., the determination of block 324), initiating, by machine 100, a remaining bonus outcome event, as at block 310, by again selecting a first symbol set from the global symbol group. In other words, portions of the set 325 can repeat to carry out distinct outcome events of the predetermined number of events.

Stated yet another way, carrying out a next outcome event can include determining, by processor 112, a second symbol set to display within the symbol-display-portion 702 for the next (e.g., second) outcome event. Additionally, processor 112 can determine a third symbol position within the symbol-display-portion 702 for the next outcome event, and then cause display 110 to simultaneously display, within the symbol-display-portion 702 for the next outcome event, the second symbol set, and the predetermined symbol resting at the third symbol position.

FIG. 6 shows an example of another first symbol set 600 selected from the global symbol group for display during an additional bonus outcome event. As described above, the additional bonus outcome event can be initiated pursuant to machine 100 making a determination that one or more of the awarded outcome events have not yet occurred (i.e., remain to occur). The displayed first symbol set 600 includes a single predetermined symbol (i.e. the Wild symbol) 510 at position C2, R3 in the arrangement. The displayed predetermined Wild symbol 510 includes a multiplier meter 524 with a multiplier value 2× within the multiplier meter 524.

The first symbol set 600 of FIG. 6 further includes two Wild symbols 602 at arrangement position C2, R1, and C2, R2. The Wild symbols 602 are not predetermined symbols as the predetermined Wild symbol 510 at symbol position C2, R3 in the arrangement shown in FIG. 6, since the two Wild symbols 602 have been randomly selected from the global symbol set as described above and, as such, are not associated with respective multipliers.

The first symbol set 600 also includes: (i) one King symbol 502 at symbol or arrangement position C1, R1, (ii) two soaring eagle symbols 518 at symbol or arrangement positions C3, R1 and C5, R1, (iii) the beaver symbol 514 at symbol or arrangement position C1, R4, (iv) the Queen symbol 520 at symbol or arrangement position C1, R2, (v) Jack symbols 604 at symbol or arrangement positions C3, R2 and C5, R2, (vi) the ten symbol 522 at symbol or arrangement position C4, R2, and (vii) the Ace symbols 508 at symbol or arrangement positions C3, R3 and C4, R3, and C5, R3.

In some embodiments, the awarding of bonus outcome events may be a game feature that is one of multiple game features of a given game. In some instances, machine 100 may make a determination that a trigger event occurred (e.g., based on a random selection in a base outcome event or base game as described above). And in response to making the determination, machine 100 may randomly select a game feature from a group of game features. Further, in response to selecting the game feature, the machine may perform the appropriate steps to execute the selected game feature. For example, where the game feature is the one described above, in response to selecting the game feature, machine 100 may make the determination as described above at block 304, and then perform one or more of the other functions described herein in connection with FIGS. 3A-3C to execute the game feature. Note that the group of game features may include a variety of different types of game features.

The one or more other functions can include, but are not limited to the following functions. Machine 100 can cause the display 110 to display movement of the predetermined symbol from resting at the first symbol position to resting at the second symbol position during the first outcome event. Machine 100 may use a fixed amount of time to move the symbol from the first symbol position to the second symbol position. The processor 112 may determine a beginning of a midpoint portion of the fixed amount of time. As an example, the beginning of the midpoint portion could occur N seconds (e.g., 3 seconds) before the midpoint of the fixed amount of time, and an end of the midpoint portion could occur N seconds after the midpoint of the fixed amount of time. Machine 100 can use the fixed amount of time to move the predetermined symbol from a first symbol position to a second symbol position for each bonus outcome event.

Machine 100 can cause the multiplier meter of the predetermined symbol to cross-fade during occurrence of the midpoint portion. Prior to the cross-fading, the multiplier meter can display a first multiplier value during the first outcome event, such an initial multiplier value selected by processor 112 or a multiplier value selected for a previous bonus outcome event. After the cross-fading, the multiplier meter can display a second multiplier value during the first outcome event. The second multiplier value can be the multiplier value used to determine a payout amount for the first outcome event. The first and second multiplier values may be the same value or different values.

Machine 100 can cause the predetermined symbol to fade out while the predetermined symbol is being displayed during the first outcome event and to spin the symbol-display segments within the symbol-display-portion 702 of display 110. While the symbol-display segments are spinning, machine 100 can cause the predetermined symbol to fade in the predetermined symbol at the second symbol position during the first outcome event and, subsequently, stop the spinning plurality of symbol-display segments.

Machine 100 can determine a path for the predetermined symbol to travel while moving from the first symbol position to the second symbol position during the first outcome event. As an example, determining the path can include processor 112 selecting a predetermined path from at least one predetermined path among at least one predetermined path for movement of the predetermined symbol from the first symbol position to the second symbol position. As another example, determining the path can include processor 112 determining a random path for the predetermined symbol to travel while moving from the first symbol position to the second symbol position. Machine 100 can be configured such that movement of the predetermined symbol is restricted to a time during which the symbol-display segments are spinning A determined path can include a multiple-SDS path, such as a multiple reel path, in which the predetermined symbol travels on or across at least two SDS. The determined path can include a multiple direction path in which the predetermined symbol travels in at least two different directions while moving from the first symbol position to the second symbol position.

Machine 100 can cause the display 110 to display the predetermined symbol as it moves along the determined path. The display 110 can display the predetermined symbol passing over at least a portion of a no-cover symbol while displaying movement of the predetermined symbol along the determined path.

Machine 100 can cause symbol-display segments to spin, and to cause spinning symbol-display segments to stop spinning The spinning and stopping of the spinning symbol-display segments can be carried out for each outcome event. In accordance with the embodiments in which the symbol-display-portion 702 includes columns or reels that spin from top to bottom or bottom to top, spinning the reels can include starting the spinning from a left-most column or reel to a right-most column or reel. Stopping the reels can occur using a similar sequence. Other sequences of spinning and stopping the spinning can be used. Moreover, the spinning or stopping of spinning of two or more columns or reels could occur simultaneously.

IV. Additional Example Operation

Figure 10A:
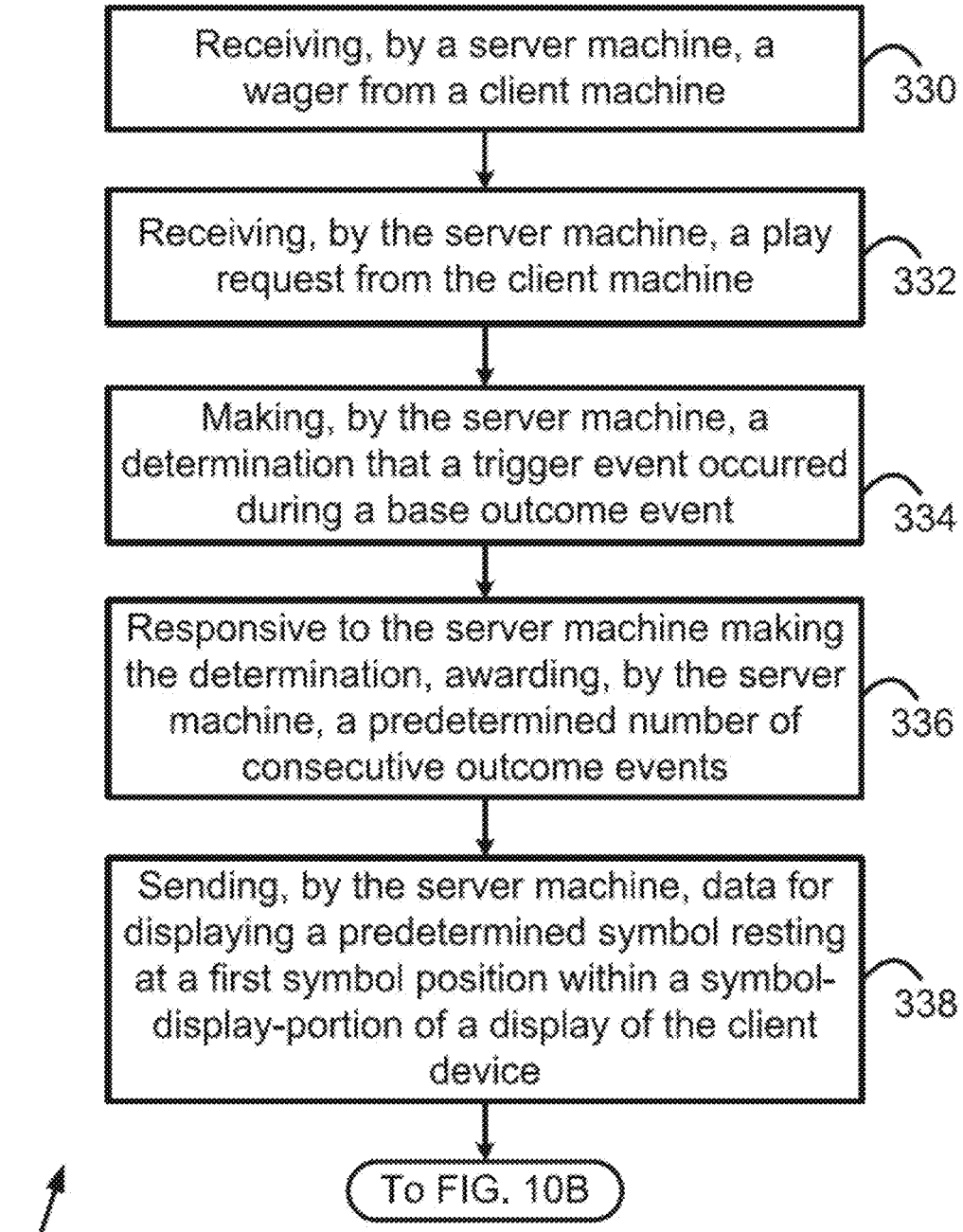
FIG. 10A is a first part of a flow chart showing functions in accordance with a method in an embodiment of the disclosure.
Figure 10B:
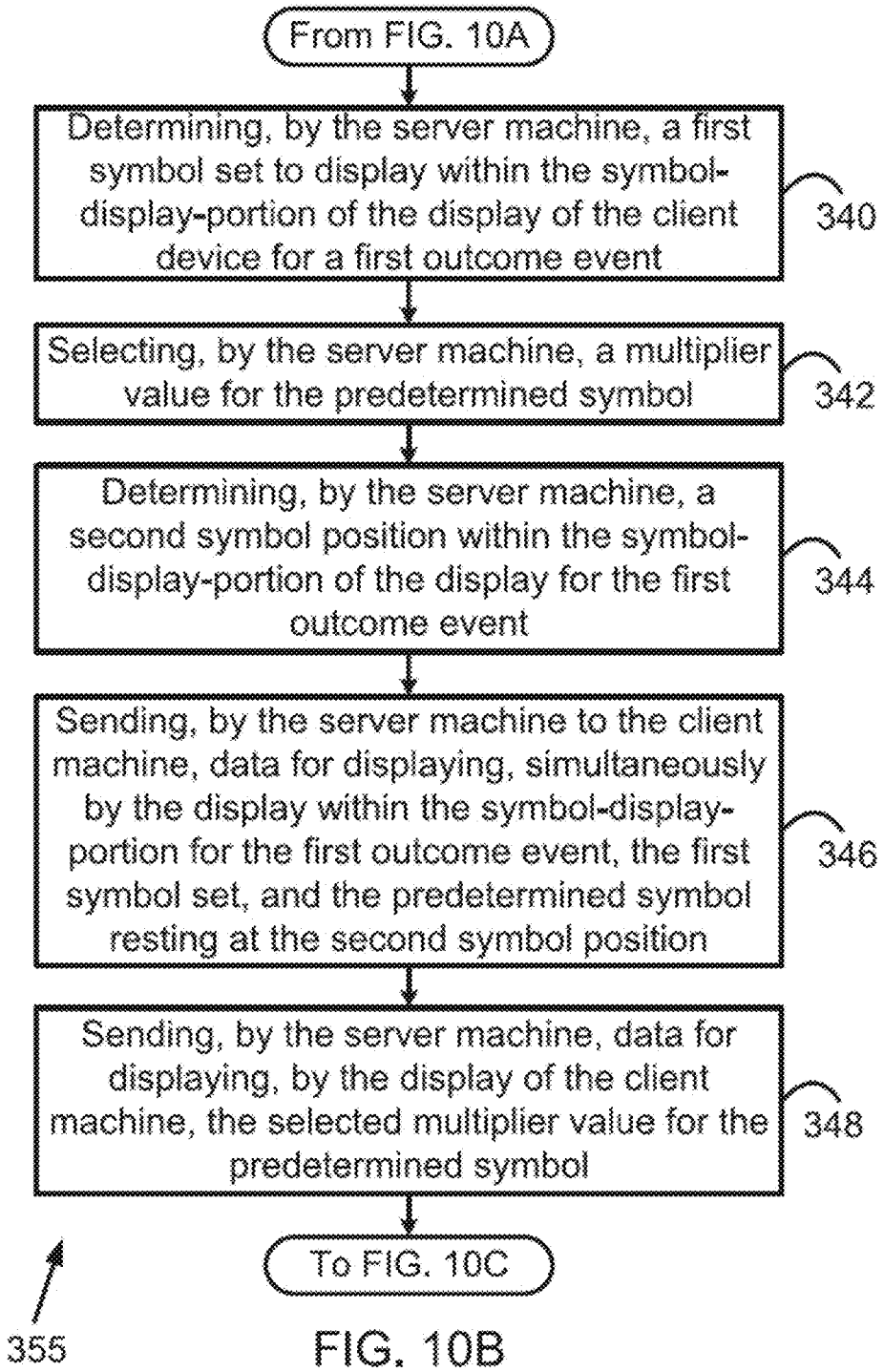
FIG. 10B is a second part of the flow chart of FIG. 10A.
Figure 10C:
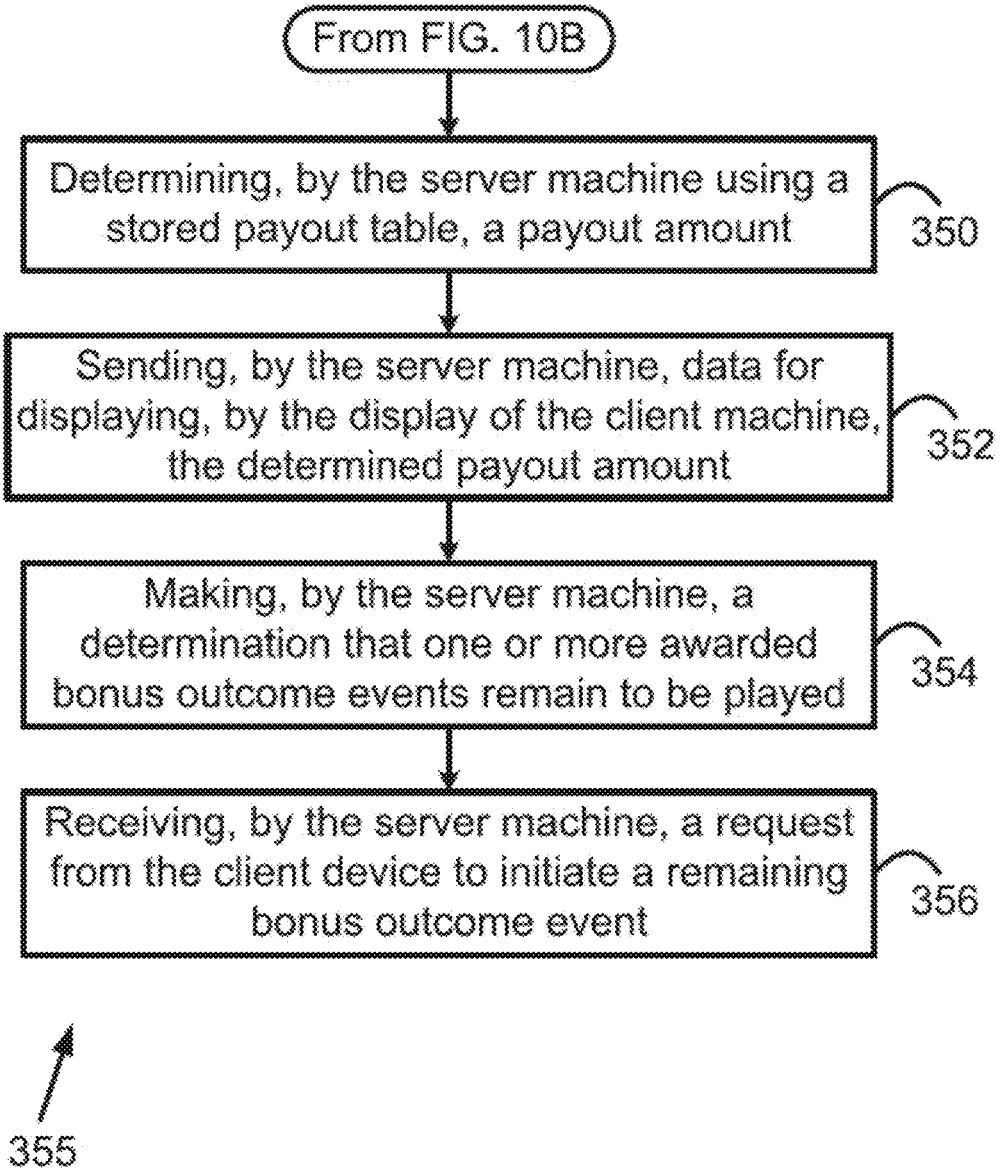
FIG. 10C is a third part of the flow chart of FIG. 10A.

FIG. 10A, FIG. 10B, and FIG. 10C (i.e., FIG. 10A-10C) depict a flowchart showing a set of functions (e.g., operations) 355 (or more simply, "the set 355") that can, for example, be carried out using server machine 100*a*. Note that several of the functions described in connection with FIG. 10A-10C parallel functions described in connection with FIG. 3A-3C. As such, variations of the functions described in connection with FIG. 3A-3C are likewise applicable to the functions described in connection with Figures FIG. 10A-10C. However, for the sake of brevity, these variations are not repeated. The server machine 100*a*, in performing the set 355, can perform the functions described above with respect to machine 100.

Turning to FIG. 10A, block 330 includes receiving, by the server machine 100*a*, a wager from the client machine 100*b*.

Next, block 332 includes receiving, by the server machine 110*a*, a play request from the client machine 100*b*.

Next, block 334 includes making, by the server machine 110*a*, a determination that a trigger event occurred during a base outcome event.

Next, block 336 includes, responsive to the server machine 110*a* making the determination (i.e., the determination of block 334), awarding, by the server machine 110*a*, a predetermined number of consecutive outcome events.

Next, block 338 includes sending, by the server machine 100*a*, data for displaying a predetermined symbol resting at a first symbol position within a symbol-display-portion of a display 110*b* of the client device 100*b*.

Turning to FIG. 10B, block 340 includes determining, by the server machine 100*a*, a first symbol set to display within the symbol-display-portion of the display 110*b* of the client device 110 for a first outcome event.

Next, block 342 includes selecting, by the server machine 100*a*, a multiplier value for the predetermined symbol.

Next, block 344 includes determining, by the server machine 100*a*, a second symbol position within the symbol-display-portion 702 of the display 110*b* for the first outcome event.

Next, block 346 includes sending, by the server machine 100*a* to the client machine 100*b*, data for displaying, simultaneously by the display 110*b* within the symbol-display-portion 702 for the first outcome event, the first symbol set, and the predetermined symbol resting at the second symbol position.

Next, block 348 includes sending, by the server machine 100*a*, data for displaying, by the display 110*b* of the client machine 100*b*, the selected multiplier value for the predetermined symbol.

Turning to FIG. 10C, block 350 includes determining, by the server machine 100*a* using a stored payout table, a payout amount.

Next, block 352 includes sending, by the server machine 100*a*, data for displaying, by the display 110*b* of the client machine 100*b*, the determined payout amount.

Next, block 354 includes making, by the server machine 100*a*, a determination that one or more awarded bonus outcome events remain to be played.

Next, block 356 includes receiving, by the server machine 100*a*, a request from the client device 100*b* to initiate a remaining bonus outcome event.

Figure 11A:
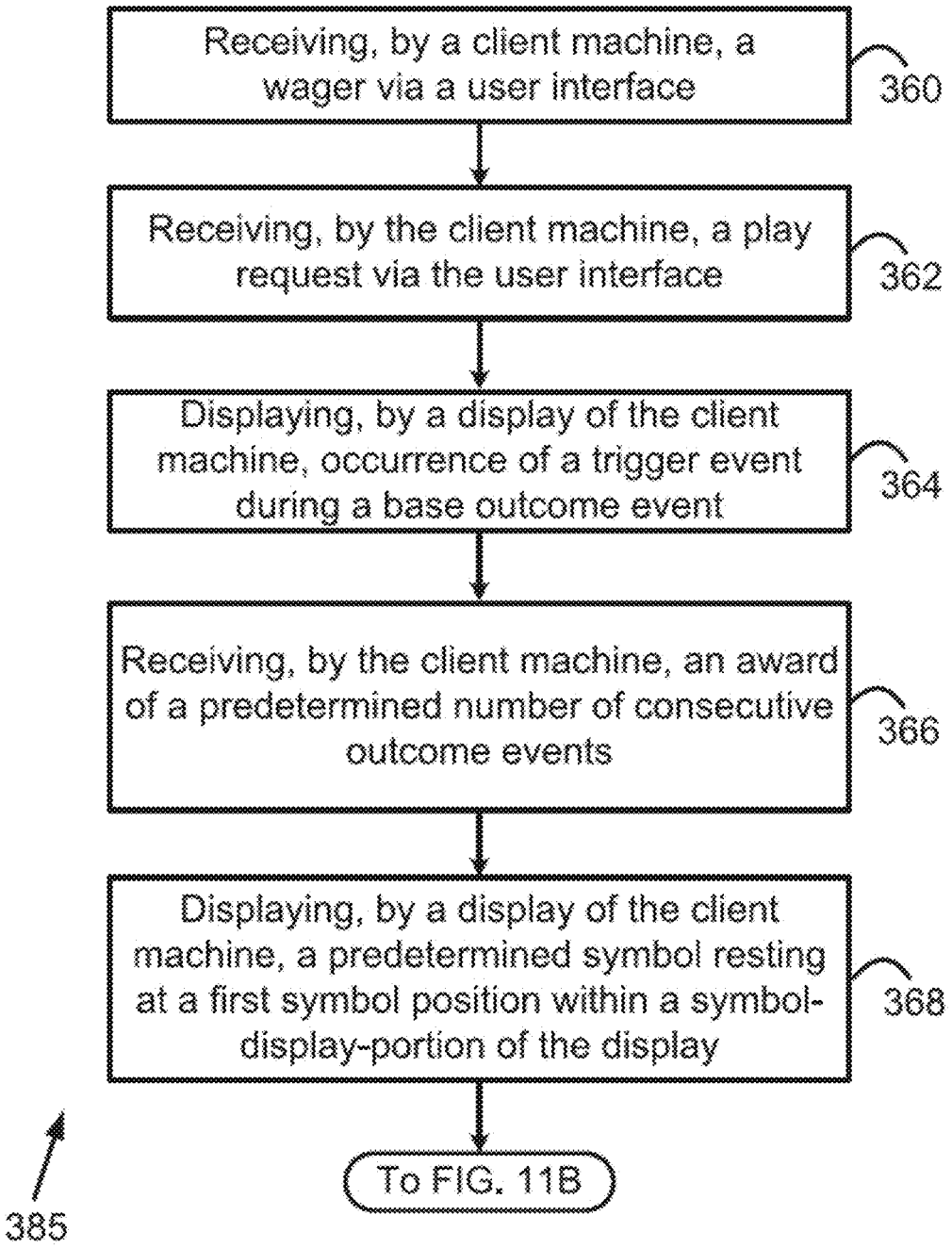
FIG. 11A is a first part of a flow chart showing functions in accordance with a method in an embodiment of the disclosure.
Figure 11B:
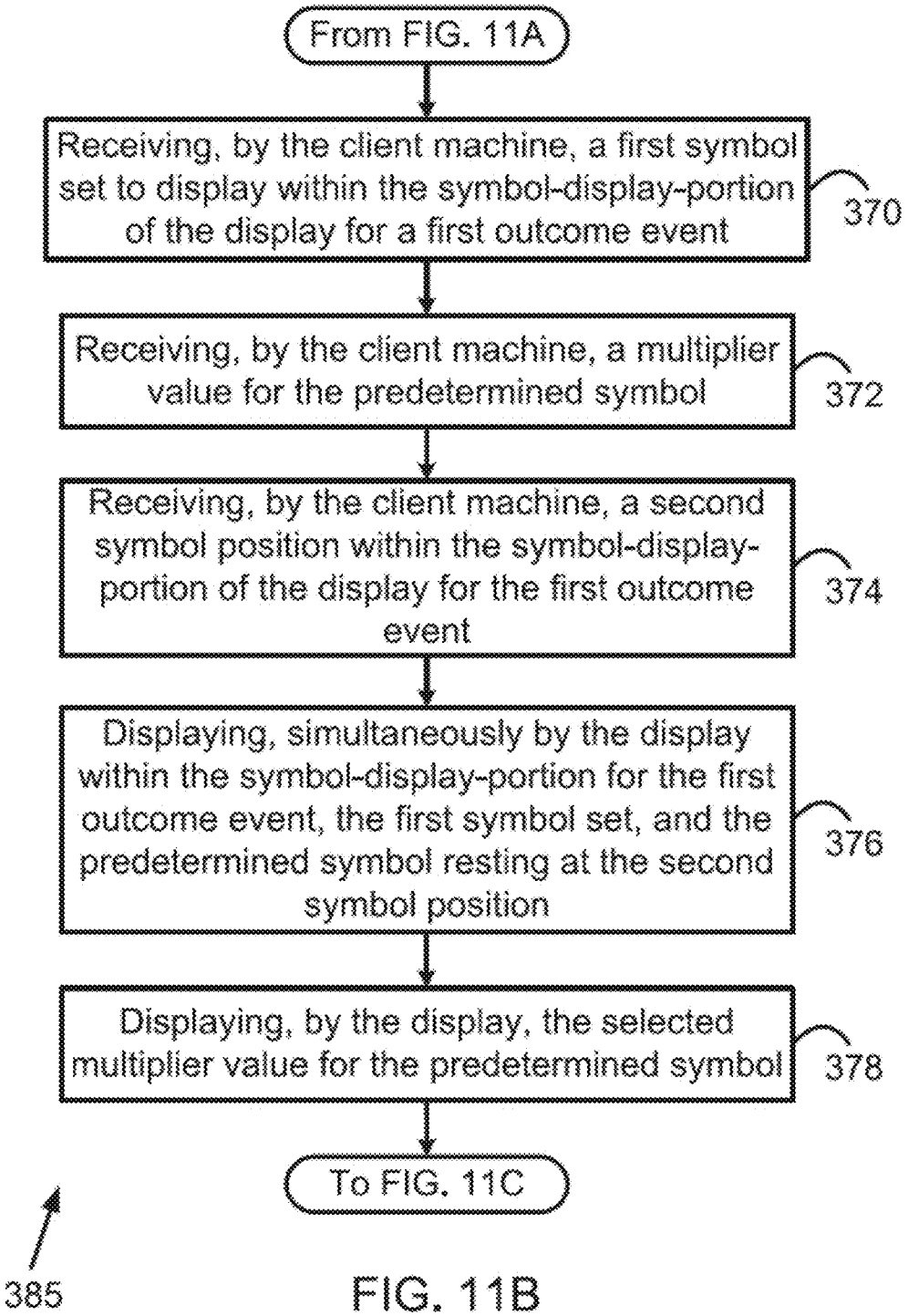
FIG. 11B is a second part of the flow chart of FIG. 11A.
Figure 11C:
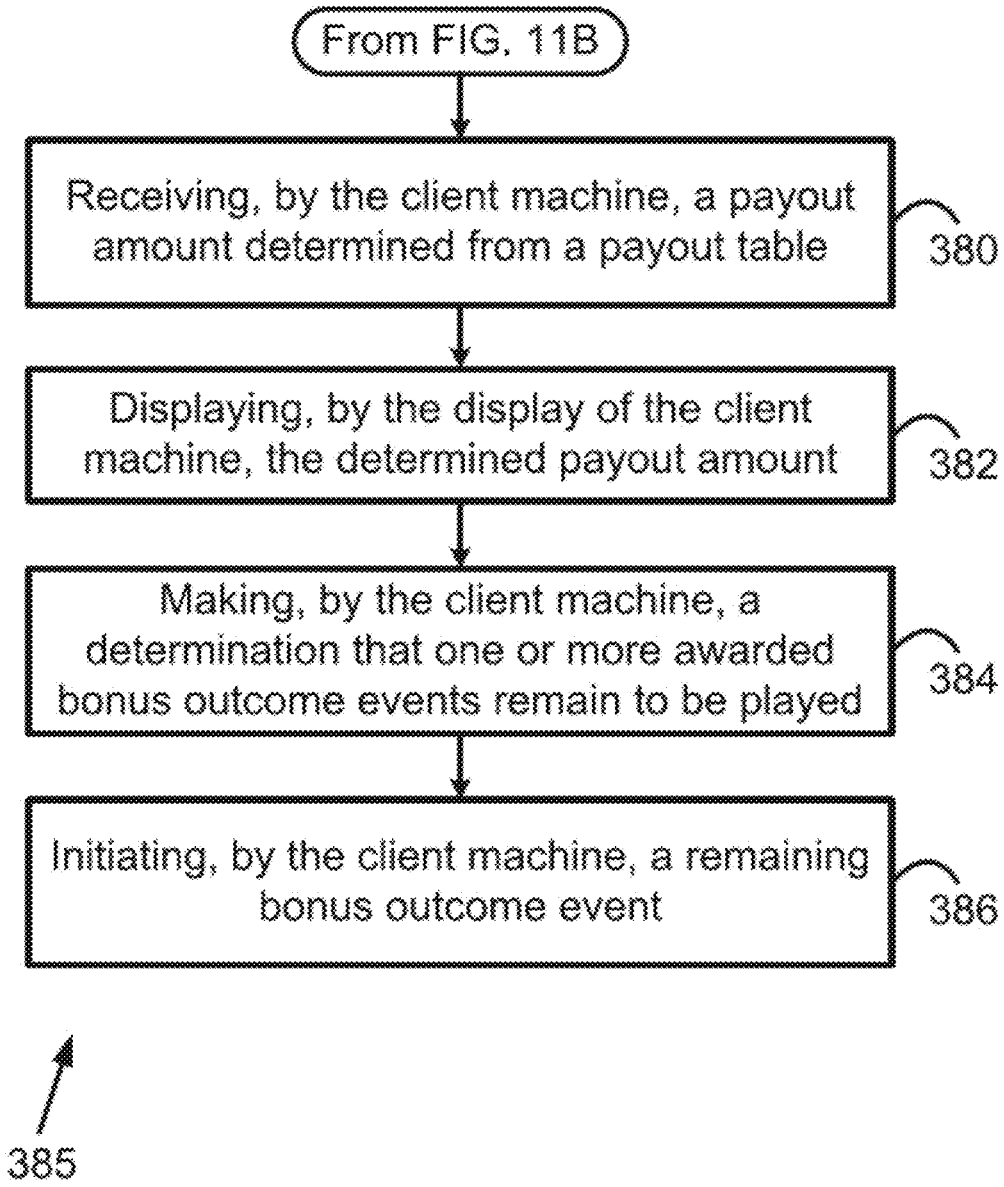
FIG. 11C is a third part of the flow chart of FIG. 11A.

FIG. 11A, FIG. 11B, and FIG. 11C (i.e., FIG. 11A-11C) depict a flowchart showing a set of functions (e.g., operations) 385 (or more simply, "the set 385") that can, for example, be carried out using client machine 100*b*. Note that several of the functions described in connection with FIG. 11A-11C parallel functions described in connection with FIG. 3A-3C and FIG. 10A-10C. As such, variations of the functions described in connection with FIG. 3A-3C and FIG. 10A-10C are likewise applicable to the functions described in connection with Figures FIG. 11A-11C. However, for the sake of brevity, these variations are not repeated. The client machine 100*b*, in performing the set 385, can perform the functions described above with respect to machine 100.

Turning to FIG. 11A, block 360 includes receiving, by the client machine 100*b*, a wager via the user interface 104*b*. Client machine 100*b* can transmit the received wager or data indicative thereof over the communication network 116 to server machine 100*a*.

Next, block 362 includes receiving, by the client machine 100*b*, a play request via the user interface 104*b*. Client machine 100*b* can transmit the received play request or data indicative thereof over the communication network 116 to server machine 100*a*.

Next, block 364 includes displaying, by a display 110*b* of the client machine 100*b*, occurrence of a trigger event during a base outcome event.

Next, block 366 includes receiving, by the client machine 100*b*, an award of a predetermined number of consecutive outcome events.

Next, block 368 includes displaying, by the display 110*b* of the client machine 100*b*, a predetermined symbol resting at a first symbol position within a symbol-display-portion 702 of the display 110*b*.

Turning to FIG. 11B, block 370 includes receiving, by the client machine 100*b*, a first symbol set to display within the symbol-display-portion of the display 110*b* for a first outcome event.

Next, block 372 includes receiving, by the client machine 100*b*, a multiplier value for the predetermined symbol.

Next, block 374 includes receiving, by the client machine 100*b*, a second symbol position within the symbol-display-portion 702 of the display 110*b* for the first outcome event.

Next, block 376 includes displaying, simultaneously by the display 110*b* within the symbol-display-portion 702 for the first outcome event, the first symbol set, and the predetermined symbol resting at the second symbol position.

Next, block 378 includes displaying, by the display 110*b*, the selected multiplier value for the predetermined symbol.

Turning to FIG. 11C, block 380 includes receiving, by the client machine 110*b*, a payout amount determined from a payout table.

Next, block 382 includes display, by the display 110*b* of the client machine 100*b*, the determined payout amount.

Next, block 384 includes making, by the client machine 100*b*, a determination that one or more awarded bonus outcome events remain to be played.

Next, block 386 includes initiating, by the client machine, a remaining bonus outcome event.

V. CONCLUSIONS

While one or more disclosed functions have been described as being performed by certain entities (e.g., machine 100, server machine 100*a*, or client machine 100*b*), one or more of the functions may be performed by any entity, including but not limited to those described herein. As such, while this disclosure includes examples in which the server machine 100*a* performs select functions and sends data to the client machine 100*b*, such that the client machine

100*b* may perform complementing functions and receive the data, variations may to those functions may be made while adhering to the general server-client dichotomy and the scope of the disclosed machines and methods.

For example, rather than the server machine 100*a* sending select data (e.g., a symbol set) to the client machine 100*b*, such that the client machine may generate and display appropriate images, the server machine 100*a* may itself generate the images and send them to the client machine 100*b* for display. Indeed, it will be appreciated by one of ordinary skill in the art that the "break point" between the server machine's functions and the client machine's functions may be varied with ease.

Further, the described functions throughout this application need not be performed in the disclosed order, although in some examples, the recited order may be preferred. Also, not all functions need to be performed to achieve the desired advantages of disclosed machines and methods, and therefore not all functions are required While examples have been described in terms of select embodiments, alterations and permutations of these embodiments will be apparent to those of ordinary skill in the art. Other changes, substitutions, and alterations are also possible without departing from the disclosed machines and methods in their broader aspects as set forth in the following claims.

The invention claimed is:

1. A method comprising:

determining, by a processor of a machine for an event prior to a first outcome event, a symbol set selected for the event prior to the first outcome event randomly from a group of symbols comprising multiple different symbols and, for each symbol of the symbol set selected for the event prior to the first outcome event, a respective symbol position of a multi-symbol position portion of a display at which that symbol of the symbol set selected for the event prior to the first outcome event is to be displayed, wherein the multi-symbol position portion of the display comprises at least a first symbol position and a second symbol position different than the first symbol position, and wherein the respective symbol position determined for a predetermined symbol within the symbol set selected for the event prior to the first outcome event is the first symbol position;

displaying, simultaneously by the display for the event prior to the first outcome event, the symbol set selected for the event prior to the first outcome event at the symbol positions of the multi-symbol position portion of the display other than the first symbol position, and the predetermined symbol resting at the first symbol position;

determining, by the processor, whether a payout is earned as a result of the event prior to the first outcome event;

determining, by the processor after determining the symbol set selected for the event prior to the first outcome event with the predetermined symbol, the second symbol position from the multiple symbol positions of the multi-symbol position portion of the display randomly to display for the first outcome event the predetermined symbol determined for the event prior to the first outcome event;

determining, by the processor, a symbol set selected for the first outcome event from the group of symbols to display within the multi-symbol position portion of the display for the first outcome event;

displaying, simultaneously by the display within the multi-symbol position portion of the display for the first outcome event, the second symbol set selected for the first outcome event at the symbol positions of the symbol-display portion other than the second symbol position, and the predetermined symbol resting at the second symbol position, and determining, by the processor, whether a payout is earned as a result of first outcome event.

2. The method of claim 1, further comprising:

displaying, by the display, movement of the predetermined symbol from resting at the first symbol position to resting at the second symbol position during the first outcome event.

3. The method of claim 2, wherein the multi-symbol position portion of the display includes a plurality of symbol-display segments, each symbol-display segment comprising at least two distinct symbol positions, wherein the plurality of symbol-display segments includes a first symbol-display segment and a second symbol-display segment;

wherein the first symbol position is a position within the first symbol-display segment, and wherein the second symbol position is a position within the first symbol-display segment or the second symbol-display segment.

4. The method of claim 3, wherein the predetermined symbol comprises a multiplier meter configured to display a multiplier value, wherein the method further comprises:

selecting, by the processor, a multiplier value from among a plurality of multiplier values; and displaying the selected multiplier value within the multiplier meter while the predetermined symbol is resting at the second symbol position for the first outcome event.

5. The method of claim 4, wherein selecting the multiplier value from among the plurality of multiplier values is conditioned upon which symbol-display segment comprises the second symbol position, wherein the plurality of symbol-display segments further includes a third symbol-display segment, a fourth symbol-display segment, and a fifth symbol-display segment, wherein the plurality of multiplier values includes a 2× multiplier value, a 3× multiplier value, a 4× multiplier value, a 5× multiplier value, and a 10× multiplier value, wherein if the first symbol-display segment, the second symbol-display segment or the third symbol display segment includes the second symbol position, then selecting the multiplier value comprises selecting one of the 2× multiplier value, the 3× multiplier value, the 4× multiplier value, the 5× multiplier value, and the 10× multiplier value, and wherein if the fourth symbol-display segment or the fifth symbol display segment includes the second symbol position, then selecting the multiplier value comprises selecting one of the 2× multiplier value, the 3× multiplier value, and the 4× multiplier value, but not either of the 5× multiplier value and the 10× multiplier value.

6. The method of claim 4, wherein displaying movement of the predetermined symbol from resting at the first symbol position to resting at the second symbol position during the first outcome event takes a fixed amount of time, wherein the method further comprises:

determining, by the processor, a beginning of a midpoint portion of the fixed amount of time;

cross-fading, by the display during occurrence of the midpoint portion of the fixed amount of time, the multiplier meter, displaying, within the multiplier meter prior to the cross-fading, a first multiplier value during the first outcome event; and displaying, within the multiplier meter after the cross-fading, a second multiplier value during the first outcome event.

7. The method of claim 3, further comprising:

spinning, by the processor, at least one symbol-display segment of the plurality of symbol-display segments while displaying the movement of the predetermined symbol from resting at the first symbol position to resting at the second symbol position during the first outcome event, wherein displaying the movement of the predetermined symbol from resting at the first symbol position to resting at the second symbol position during the first outcome event takes a fixed amount of time, and wherein displaying movement of the predetermined symbol from being at rest at one symbol position within the multi-symbol position portion until resting again at another symbol position within the multi-symbol position portion for each different outcome event configured for displaying the predetermined symbol takes the fixed amount of time.

8. The method of claim 2, wherein the predetermined symbol comprises a multiplier meter configured to display a multiplier value, wherein the method further comprises:

selecting, by the processor, a multiplier value from among a plurality of multiplier values; and displaying the selected multiplier value within the multiplier meter while the predetermined symbol is resting at the second symbol position for the first outcome event.

9. The method of claim 1, further comprising:

fading out, by the display during the first outcome event, the predetermined symbol resting at the first symbol position;

spinning, by the processor, a plurality of symbol-display segments within the multi-symbol position portion of the display;

fading in, by the display during the first outcome event while the plurality of symbol-display segments are spinning, the predetermined symbol at the second symbol position; and subsequently stopping, by the processor, the spinning plurality of symbol-display segments.

10. The method of claim 1, further comprising:

determining, by the processor, occurrence of a trigger event while the machine is operating in a first state; and transitioning, by the processor in response to determining the occurrence of the trigger event, the machine from operating in the first state to operating in a second state, wherein the machine is configured to carry out, while operating in the first state, base outcome events in which the display displays sets of symbols selected from a global symbol set, but not the predetermined symbol, and wherein the machine is configured to carry out, while operating in the second state, bonus outcome events in which the display displays sets of symbols selected from the global symbol set and the predetermined symbol.

11. The method of claim 1, further comprising:

paying out, by the machine, a payout amount if the payout is earned as a result of the first outcome event.

12. The method of claim 11, further comprising:

displaying, by the display of the machine, the payout amount; and displaying, by the display of the machine, a count-up from a first balance amount to a second balance amount, wherein the second balance amount equals a sum of the first balance amount and the payout amount.

13. The method of claim 12, further comprising:

displaying, by the display of the machine during the count-up, a glowing win animation within the predetermined symbol.

14. The method of claim 13, wherein displaying the glowing win animation includes providing, by the processor to the display, a sequence of images of the predetermined symbol, wherein a portion of each image of the predetermined symbol is a glowing portion, and wherein the images of the sequence of images are arranged in an order of intensity of the glowing portion of each image of the predetermined symbol from a dimmest intensity to a brightest intensity or from the brightest intensity to the dimmest intensity.

15. A machine comprising: a display configured to display symbols in a wager outcome event; a processor; and a non-transitory computer-readable medium storing program instructions, that when executed by the processor, cause a set of functions to be performed, the set of functions comprising:

determining, for an event prior to a first outcome event, a symbol set selected for the event prior to the first outcome event randomly from a group of symbols comprising multiple different symbols and, for each symbol of the symbol set selected for the event prior to the first outcome event, a respective symbol position of a multi-symbol position portion of a display at which that symbol of the symbol set selected for the event prior to the first outcome event is to be displayed, wherein the multi-symbol position portion of the display comprises at least a first symbol position and a second symbol position different than the first symbol position, and wherein the respective symbol position determined for a predetermined symbol within the symbol set selected for the event prior to the first outcome event is the first symbol position;

displaying, simultaneously by the display, for the event prior to the first outcome event, the symbol set selected for the event prior to the first outcome event at the symbol positions of the multi-symbol position portion of the display other than the first symbol position, and the predetermined symbol resting at the first symbol position;

determining whether a payout is earned as a result of the event prior to the first outcome event;

determining, after determining the symbol set selected for the event prior to the first outcome event with the predetermined symbol, the second symbol position from the multiple symbol positions of the multi-symbol position portion of the display randomly to display for the first outcome event the predetermined symbol determined for the event prior to the first outcome event;

determining a symbol set selected for the first outcome event from the group of symbols to display within the multi-symbol position portion of the display for the first outcome event;

displaying, simultaneously by the display within the multi-symbol position portion of the display for the first outcome event, the symbol set selected for the first outcome event at the symbol positions of the symbol-display portion other than the second symbol position, and the predetermined symbol resting at the second symbol position, and determining, by the processor, whether a payout is earned as a result of first outcome event.

16. The machine of claim 15, wherein the set of functions further comprises:

displaying, by the display, movement of the predetermined symbol from resting at the first symbol position to resting at the second symbol position during the first outcome event.

17. The machine of claim 15, wherein the set of functions further comprises:

fading out, by the display during the first outcome event, the predetermined symbol resting at the first symbol position;

spinning, by the processor, a plurality of symbol-display segments within the multi-symbol position portion of the display; and fading in, by the display during the first outcome event while the plurality of symbol-display segments are spinning, the predetermined symbol at the second symbol position and subsequently stopping, by the processor, the spinning plurality of symbol-display segments.

18. A method comprising:

determining, by a processor of a client machine for an event prior to a first outcome event, a symbol set selected for the event prior to the first outcome event randomly from a group of symbols comprising multiple different symbols and, for each symbol of the symbol set selected for the event prior to the first outcome event, a respective symbol position of a multi-symbol position portion of a display of the client machine at which that symbol of the symbol set selected for the event prior to the first outcome event is to be displayed, wherein the multi-symbol position portion of the display comprises at least a first symbol position and a second symbol position different than the first symbol position, and wherein the respective symbol position determined for a predetermined symbol within the symbol set selected for the event prior to the first outcome event is the first symbol position;

displaying, simultaneously by the display of the client machine for the event prior to the first outcome event, the symbol set selected for the event prior to the first outcome event at the symbol positions of the multi-symbol position portion of the display other than the first symbol position, and the predetermined symbol resting at the first symbol position;

displaying, by the display, an indication of whether a payout is earned as a result of the event prior to the first outcome event;

determining, by the processor after determining the symbol set for the event prior to the first outcome event with the predetermined symbol, the second symbol position from the multiple symbol positions of the multi-symbol position portion of the display randomly to display for the first outcome event the predetermined symbol determined for the event prior to the first outcome event;

receiving, by a communication interface from a server machine, a symbol set selected for the first outcome event from the group of symbols to display within the multi-symbol position portion of the display for the first outcome event;

displaying, simultaneously by the display within the multi-symbol position portion of the display for the first outcome event, the symbol set selected for the first outcome event at the symbol positions of the symbol-display portion other than the second symbol position, and the predetermined symbol resting at the second symbol position; and displaying, by the display, an indication of whether a payout is earned as a result of the first outcome event.

19. The method of claim 18, further comprising:

displaying, by the display, movement of the predetermined symbol from resting at the first symbol position to resting at the second symbol position during the first outcome event.

20. The method of claim 18, further comprising:

fading out, by the display during the first outcome event, the predetermined symbol resting at the first symbol position;

spinning, by the processor, a plurality of symbol-display segments within the multi-symbol position portion of the display;

fading in, by the display during the first outcome event while the plurality of symbol-display segments are spinning, the predetermined symbol at the second symbol position; and subsequently stopping, by the processor, the spinning plurality of symbol-display segments.

* * * * *